US007523712B2

(12) United States Patent
Sadasue

(10) Patent No.: US 7,523,712 B2
(45) Date of Patent: Apr. 28, 2009

(54) SEWING MACHINE

(75) Inventor: Kazuya Sadasue, Tokyo (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 11/984,067

(22) Filed: Nov. 13, 2007

(65) Prior Publication Data

US 2008/0134950 A1 Jun. 12, 2008

(30) Foreign Application Priority Data

Nov. 15, 2006 (JP) ..... P.2006-308878

(51) Int. Cl.
*D05B 57/02* (2006.01)
*D05B 57/30* (2006.01)

(52) U.S. Cl. ..... 112/302; 112/199; 112/220

(58) Field of Classification Search ..... 112/165, 112/166, 197–200, 302, 220
See application file for complete search history.

(56) References Cited

U.S. PATENT DOCUMENTS 3,333,560 A * 8/1967 Wiener et al. ..... 112/199
4,977,842 A * 12/1990 Fukao et al. ..... 112/199
5,165,582 A * 11/1992 Andrews ..... 223/99
5,237,942 A * 8/1993 Satoma ..... 112/162
5,255,622 A * 10/1993 Baba et al. ..... 112/162
5,301,622 A * 4/1994 Sakuma ..... 112/162
5,327,841 A * 7/1994 Sakuma ..... 112/162
5,664,509 A * 9/1997 Tseng ..... 112/200
7,011,032 B1 * 3/2006 Chang ..... 112/200

FOREIGN PATENT DOCUMENTS

JP 2865470 12/1998

* cited by examiner

*Primary Examiner*—Ismael Izaguirre
(74) *Attorney, Agent, or Firm*—Drinker Biddle & Reath LLP

(57) ABSTRACT

A sewing machine includes a looper formed with a thread hole, a looper shaft holding the looper, and a thread pipe fixed to the looper shaft. The thread pipe includes a thread inserting port at one end and a thread discharging port at the other end. The sewing machine further includes a nozzle from which air is sprayed toward the thread inserting port, a switching mechanism operable to disconnect the looper from the looper shaft when the looper is at a front position, and a moving member which moves the looper to a rear position when the looper is disconnected from the looper shaft by the switching mechanism. When the looper is disconnected from the looper shaft and is moved to the rear position, the thread discharging port matches the thread hole, and the thread inserting port becomes close to the nozzle.

12 Claims, 13 Drawing Sheets

SEWING MACHINE

CROSS-REFERENCE TO RELATED APPLICATION(S)

The present application claims priority from Japanese Patent Application No. 2006-308878 filed on Nov. 15, 2006, the entire content of which is incorporated herein by reference.

TECHNICAL FIELD

The present invention relates to a sewing machine having a threading device for inserting a lower thread into a thread hole of a looper.

BACKGROUND ART

There is a threading device in which compressed air is sprayed onto a thread inserting port of a thread pipe, guiding a lower thread toward a thread hole of a looper, to insert the lower thread into the thread hole of the looper through the thread pipe by an air flow (see, e.g., Japanese Patent No, 2865470).

When the looper, which swivels back and forth, is at a front position, an upper thread is usually being caught by the looper. When inserting the lower thread into the thread hole of the looper in this state, it is cumbersome to pull away the upper thread passing through the looper or to consider the order of threading.

In a looper mechanism disclosed in the Japanese Patent No. 2865470, moreover, the looper is swiveled interlockingly with a rotation of a main shaft (a lower shaft) which serves as a driving shaft. Thus, in order to prevent the threading work from being hindered by a movement of the looper, it is necessary to stop and keep the looper at a predetermined position when inserting the lower thread into the looper.

Accordingly, as shown in FIG. 14, an operator of the sewing machine has to manually operate a locking mechanism for locking the main shaft by one hand while rotating the main shaft so as to find a phase of the looper (i.e., a rotating angle of the main shaft) that matches the locking mechanism by the other hand. In other words, when inserting the lower thread into the thread hole of the looper, it is necessary to use both hands. Thus, there is a problem that the operations are cumbersome.

SUMMARY

It is an object of the present invention to facilitate a threading work to insert a thread into a looper.

According to an aspect of the invention, a sewing machine includes a looper having an extended portion. A thread hole is formed on a tip portion of the extended portion, and a looper groove is formed along the extended portion. The sewing machine further includes a looper shaft holding the looper such that the looper is swivelable between a front position and a rear position in synchronization with a vertical motion of a needle and interlockingly with a motor, and a thread pipe fixed to the looper shaft such that the thread pipe is swivelable between a front position and a rear position. A thread inserting port at one end of the thread pipe and a thread discharging port at the other end of the thread pipe is communicated such that a thread can be inserted therethrough. The sewing machine further includes air supplying means for supplying air toward the thread inserting port when a nozzle is disposed at a spraying position opposed to the thread inserting port of the thread pipe, switching means for disconnecting the looper from the looper shaft when the looper is at the front position, and moving means for moving the looper, which is disconnected from the looper shaft by the switching means, to the rear position. When the looper is disconnected from the looper shaft and is moved to the rear position, the thread discharging port of the thread pipe becomes coincident with the thread hole of the looper which is moved to the rear position, and the thread inserting port of the thread pipe becomes coincident with a tip of the nozzle disposed at the spraying position.

The sewing machine may further include a looper support member supporting the looper and is rotatable with respect to the looper shaft, a looper driving member fixed to the looper shaft, and a coupling member which is movable along an axial direction of the looper shaft. The coupling member may be operable to connect or disconnect the looper support member and the looper driving member when the coupling member is moved while the looper and the thread pipe are disposed at the respective rear positions.

The sewing machine may further include a main shaft locking mechanism which positions a main shaft at a predetermined rotating angle at which the thread pipe is disposed at the front position through the looper shaft, and operation input means for moving the nozzle to the spraying position, bringing the switching means into a disconnecting state, and bringing the main shaft locking mechanism into an operable state.

The air supplying means may allow the nozzle to move between the spraying position and a standby position placed apart from the spraying position. The air supplying means may include nozzle biasing means for biasing the nozzle toward the spraying position. A position of the operation input means may be switchable between a holding position at which the nozzle is held at the standby position against a biasing force of the nozzle biasing means and a permitting position at which the nozzle biasing means is movable to the spraying position by the biasing force.

The sewing machine may further include detecting means for detecting that the main shaft is positioned at the predetermined rotating angle by the main shaft locking mechanism, and motor control means for starting of a rotation of the motor when the main shaft locking mechanism is brought into the operable state in accordance with an input operation from the operation input means and stopping the rotation of the motor when the main shaft is positioned at the predetermined rotating angle.

The main shaft locking mechanism may include a rotating member having an engaging portion and fixed to the main shaft, a lock member which positions the main shaft at the predetermined rotating angle when engaged with the engaging portion, and lock member biasing means for biasing the lock member in a direction in which the lock member engages with the engaging portion.

The engaging portion may be an opening portion formed on the rotating member, and the lock member may engage with the opening portion of the rotating member in an axial direction of the main shaft.

The lock member may engage with the opening portion of the rotating member in a radial direction of the main shaft.

The main shaft locking mechanism may further includes a link member which rotates in accordance with an input operation from the operation input means. The lock member and the link member may share a same rotating axis and are separately rotatable. The lock member biasing means may include a tension spring coupling the link member and the lock member.

The sewing machine may further include an operating member which is movable when operated from an outside of the sewing machine, and a main shaft locking mechanism which positions a main shaft at a predetermined rotating angle, at which the thread pipe is movable to the front position, interlockingly with the movement of the operating member. The switching means may include a switching member coupled to the looper and supported by the looper shaft so as to be movable along an axial direction of the looper shaft such that the switching member disconnects the looper from the looper shaft interlockingly with the movement of the operating member when the looper is disposed at the front position. The moving means may include an acting member which moves the looper to the rear position when the switching member is moved to disconnect the looper from the looper shaft.

The sewing machine may further include an operating member which is movable when operated from an outside of the sewing machine, and a main shaft locking mechanism which positions a main shaft at a predetermined rotating angle, at which the thread pipe is movable to the front position, interlockingly with the movement of the operating member. The air supplying means may be operable to move the nozzle between to the spraying position and a standby position placed apart from the spraying position. The operating member may be coupled to the nozzle such that, when the operating member is moved, the looper is disposed at the rear position and the nozzle is moved to the spraying position.

Other aspects and advantages of the invention will be apparent from the following description, the drawings and the claims.

DETAILED DESCRIPTION

Hereinafter, exemplary embodiments of the invention will be explained with reference to the drawings, the following exemplary embodiments do not limit the scope of the invention. In the following exemplary embodiments, description will be given by taking a double chainstitch sewing machine as an example of a sewing machine. The double chainstitch sewing machine includes needles 4 which move in a vertical direction and a looper 21 (a double chain looper) which inserts a looper thread T through loops of sewing threads (i.e., needle threads or upper threads), which is inserted through the needles 4, below a cloth (a workpiece). The double chainstitch sewing machine sequentially crosses the threads by the needles 4 and the looper 21, and forms a double chainstitches on the cloth.

In the following description, a Z-axis direction is the vertical direction (an up-and-down direction), a Y-axis direction (a right-and-left direction) is a longitudinal direction of an arm portion 2*a* of a sewing machine 1 in a state in which the sewing machine 1 is placed on a horizontal plane, and an X-axis direction (a front-and-rear direction) is a direction parallel to a surface of a throat plate (not shown) and orthogonal to the Y-axis direction. The X-axis direction, the Y-axis direction and the Z-axis direction are orthogonal to each other.

FIRST EXEMPLARY EMBODIMENT

Figure 1:
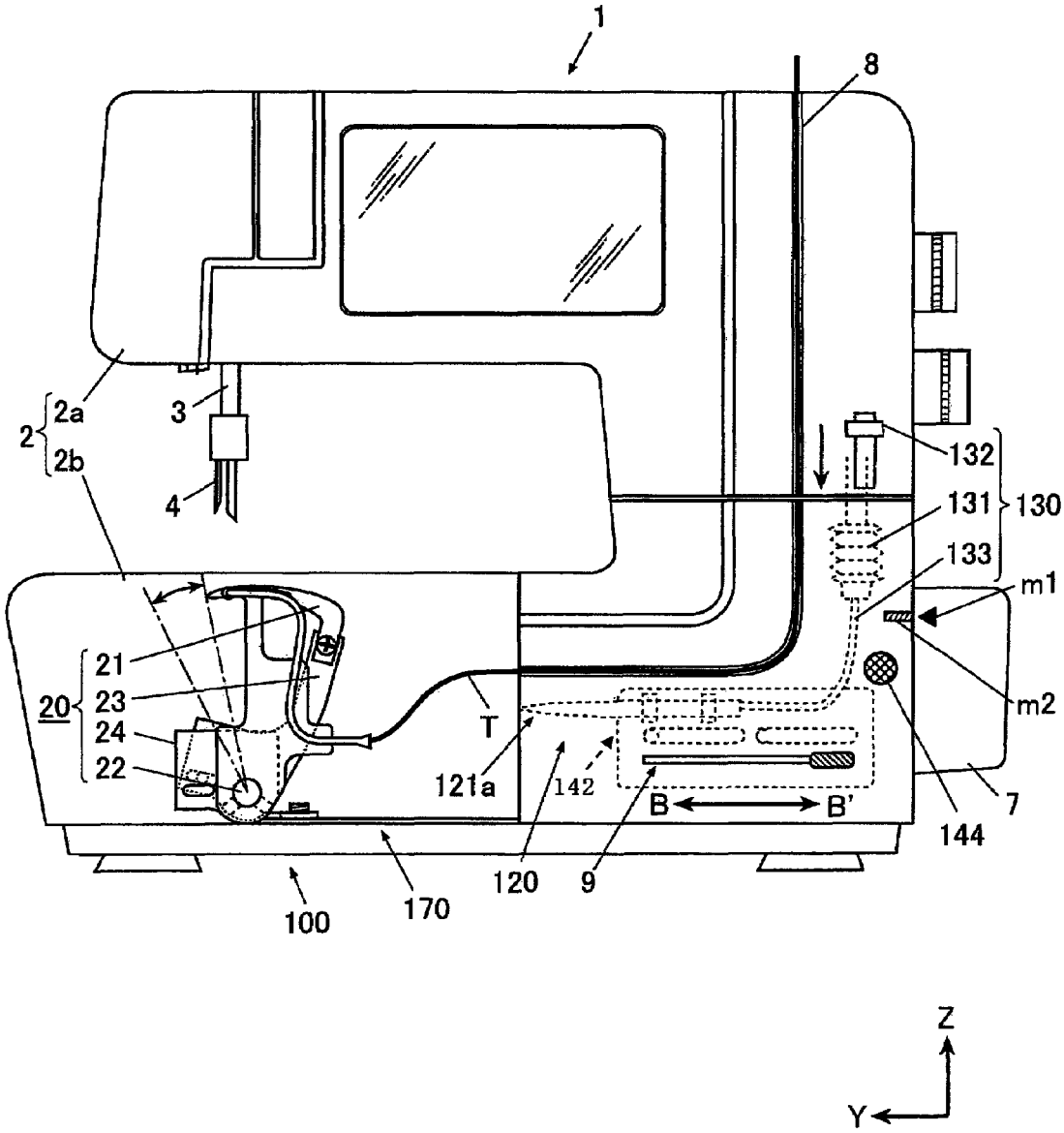
FIG. 1 is a schematic view of a sewing machine according to an exemplary embodiment of the invention.
Figure 10:
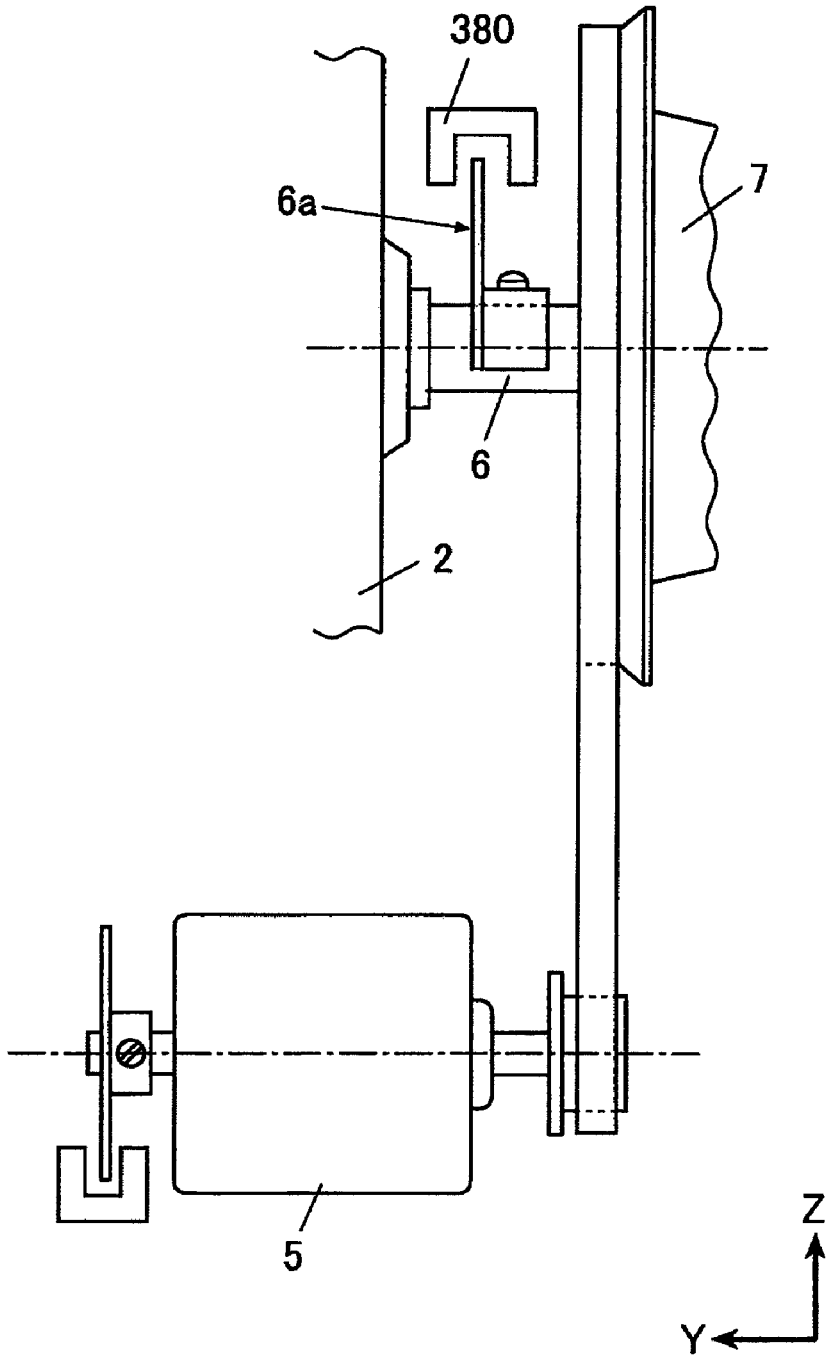
FIG. 10 is a schematic view showing a main shaft sensor according to the third exemplary embodiment of the invention.

As shown in FIG. 1, a sewing machine 1 (a double chainstitch sewing machine) includes a needle driving mechanism (not shown) which drives sewing needles 4 (needles) with a motor 5 (see FIGS. 10 and 11), a looper driving mechanism 20 having a looper 21 which forms a seam by cooperating with the needles 4, and a threading device 100 which inserts a looper thread T through a thread hole 21*b* of the looper 21. Each portion will be described below in detail.

Needle Driving Mechanism

The needle driving mechanism (not shown) includes an upper shaft (not shown) which is rotated by the motor 5, and a vertical motion transmitting mechanism which converts a rotating motion of the upper shaft into a vertical reciprocating motion through a rotating weight and a crank rod and transmits the vertical reciprocating motion to a needled bar 3. Two needles 4 are held on a lower end of the needle bar 3. When the upper shaft is rotated by a driving operation of the motor 5, the vertical motion is given to the needle bar 3 through the vertical motion transmitting mechanism so that the needle bar 3 and the needle 4 carry out the vertical reciprocating motion.

Looper Driving Mechanism

The looper driving mechanism 20 is arranged below a throat plate (not shown). The looper driving mechanism 20 includes a looper driving shaft 22 which is rotatably supported on a frame 2 along the X-axis direction, a rotation transmitting mechanism (not shown) which is branched from a lower shaft 6 (a main shaft) and converts a rotating force of the lower shaft 6 into a rotational reciprocating force to transmit the rotational reciprocating force to the looper driving shaft 22 (see FIG. 2), a looper driving arm 24 which is fixed to a tip portion of the looper driving shaft 22 and swivels around the lower shaft 6, a looper support arm 23 attachable and detachable with respect to the looper driving arm 24, and the looper 21 held at a swiveling end portion of the looper support arm 23.

The rotational reciprocating force is applied to the looper driving shaft 22 from the lower shaft 6 via the rotation transmitting mechanism (not shown), whereby the looper driving shaft 22 carries out a reciprocating rotation in synchronization with the rotation of the lower shaft 6. The looper driving shaft 22 functions as a looper shaft which swivels the looper 21 and a thread pipe 110 between front positions and rear positions, respectively.

The looper driving arm 24 is fixed to the looper driving shaft 22 and is swiveled in accordance with the rotation of the looper driving shaft 22. The looper driving arm 24 is formed with a slot 24*a* on a left side of a coupling portion to the looper driving shaft 22 when seen in a direction D shown in FIG. 3, such that a release pin 152 of a switching mechanism 150 can be inserted through the slot 24*a*. A thread guide plate 113 (a thread pipe support member) is detachably attached to the looper driving arm 24. The thread guide plate 113 supports the thread pipe 110.

The looper support arm 23 is rotatably fitted in the looper driving shaft 22 so as to be juxtaposed with the looper driving arm 24. The looper support arm 23 is formed with a slot 23*a* at a position corresponding to the slot 24*a* of the looper driving arm 24, i.e., on a left side of a coupling portion to the looper driving shaft 22 when seen in a direction D shown in FIG. 3, such that the release pin 152 can be inserted through the slot 23*a* (see FIGS. 3 and 4). A base end of the looper 21 is attached to an upper end of the looper support arm 23, Namely, the looper support arm 23 functions as a looper support member which can be connected or disconnected with respect to the looper driving shaft 22 in accordance with a switching mechanism 150 while supporting the looper 21.

Figure 3:
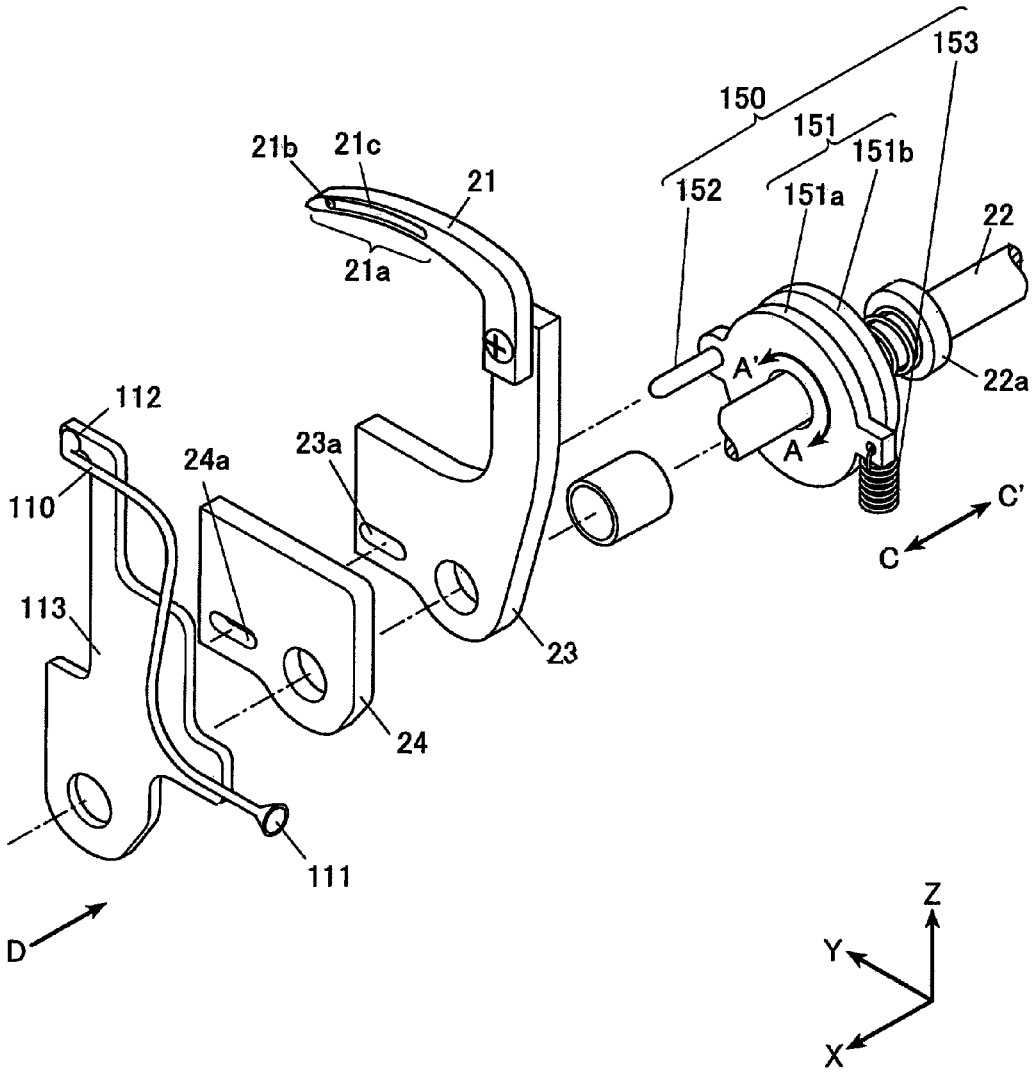
FIG. 3 is another exploded perspective view showing a part of the threading device.
Figure 4A:
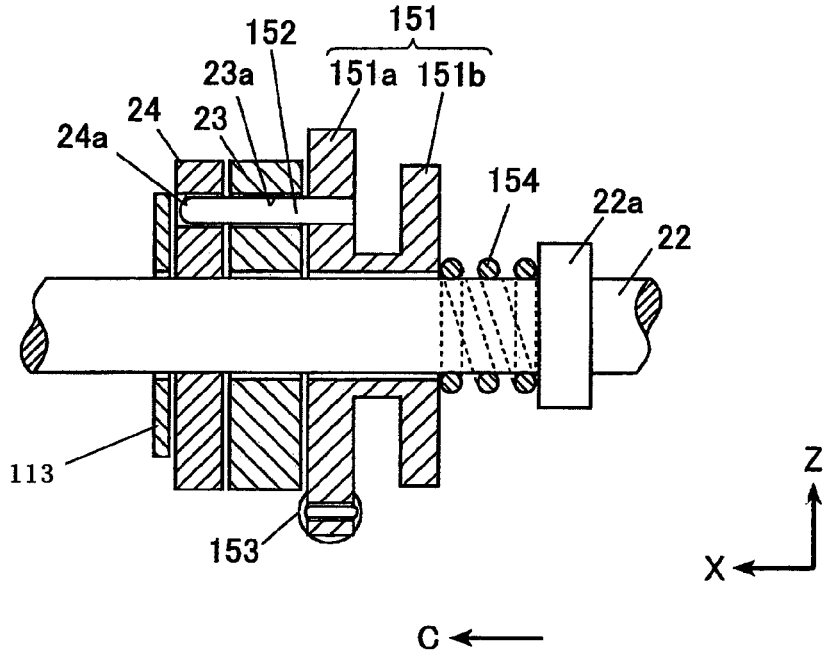
FIGS. 4A and 4B are sectional views of switching means according to the first exemplary embodiment.

The looper 21 includes an extended portion 21*a* which can be inserted into the loops of the needle threads by moving back and forth in synchronization with the vertical motion of the needles 4. As shown in FIG. 3, a tip portion of the extended portion 21*a* is formed with a thread hole 21*b* through which the looper thread T discharged from a thread discharging port 112 of the thread pipe 110 is inserted. A looper groove 21*c* is formed on the extended portion 21*a* from the thread hole 21*b* along a portion facing the thread discharging port 112. The looper groove 21*c* prevents the looper thread T discharged from the thread discharging port 112 from being stuck between the thread discharging port 112 and the extended portion 21*a*, so that the swiveling of the looper 21 can be prevented from being blocked. When the looper driving arm 24 is swiveled by the rotation of the looper driving shaft 22 so that the looper support arm 23 is swiveled together with the looper driving arm 24, the looper 21 moves so as to pass right behind a moving path of the needles 4 below the throat plate. Namely, the looper 21 is driven by obtaining a power from the motor 5 through the looper driving shaft 22 interlocking with the lower shaft 6, and catches the loops of the needle threads which are inserted through the respective needles 4 that are moved down, thereby inserting a loop of the looper thread T into the loops of the needle threads.

Figure 5A:
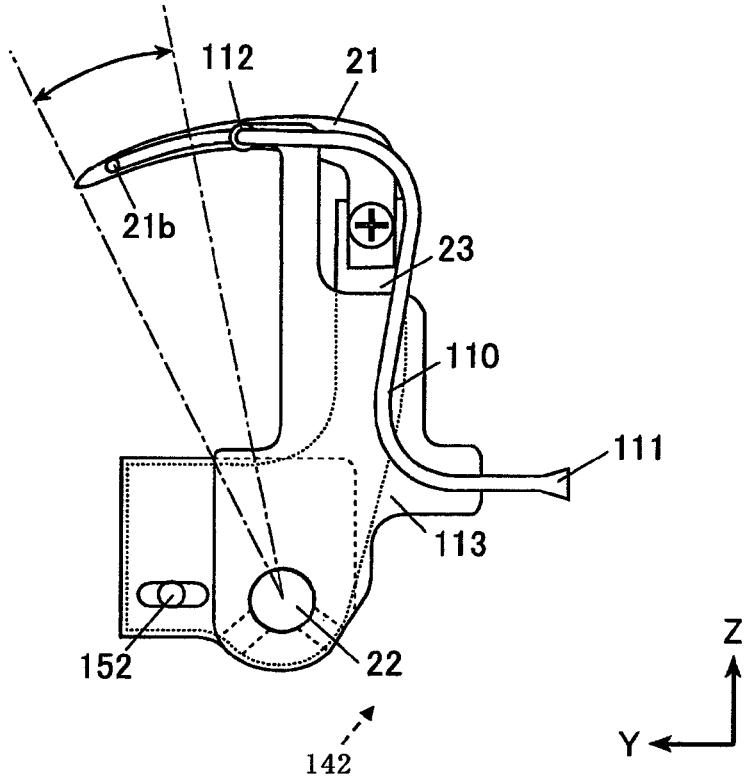
FIGS. 5A and 5B are views illustrating operations of the threading device, FIG. 5A showing a looper and a thread pipe at their front positions and FIG. 5B showing the looper at a rear position and the thread pipe at the front position.

A flywheel 7 is attached to one end of the lower shaft 6 extended to an outside of the frame 2. The flywheel 7 and the lower shaft 6 are coupled so to be rotatable together. An indicator m1 is provided on an edge portion of the flywheel 7, and an indicator m2 is provided on an edge portion of the frame 2 near the indicator m1 (see FIG. 1). In the first exemplary embodiment, when the lower shaft 6 (the main shaft of the sewing machine) is positioned at a predetermined rotating angle, i.e., when the looper 21, which is swiveled in synchronization with the rotation of the lower shaft 6, is at a forefront swiveling end (a front position) in its back and forth movement (see FIG. 5A), the indicator m1 of the flywheel 7 matches the indicator m2 of the frame 2.

Threading Device

Next, description will be given to the threading device 100 according to the first exemplary embodiment.

The threading device 100 is for inserting the looper thread T, which is guided along a thread groove 8 formed on the frame 2, through the thread hole 21*b* of the looper 21, and is provided inside a bed portion 2*b* shown in FIG. 1.

Figure 13:
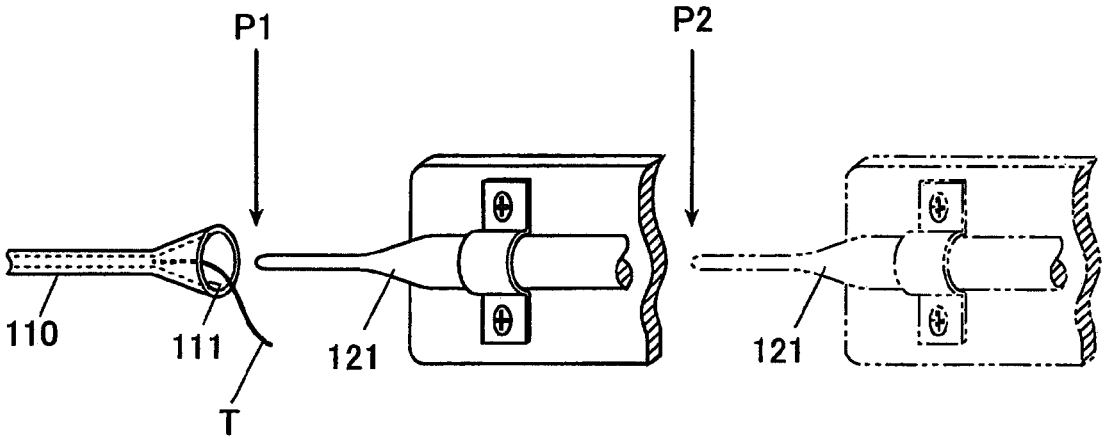
FIG. 13 is a view illustrating an operation of a nozzle of air supplying means according to an exemplary embodiment of the invention, P1 showing a spraying position and P2 showing a standby position.
Figure 14:
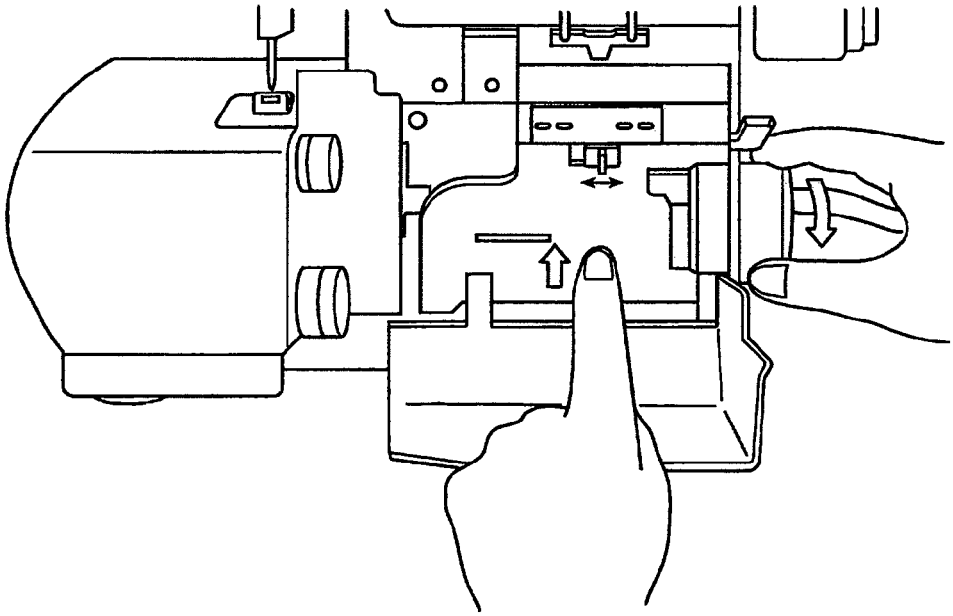
FIG. 14 is a view illustrating a threading operation.

As shown in FIGS. 1 to 6C, the threading device 100 includes the thread pipe 110 (thread guiding means), an air spraying unit 120 (air supplying means), the switching mechanism 150 (switching means), a spring 153 (moving means), a main shaft locking mechanism 160, and an interlocking mechanism 170 (interlocking means). The thread pipe 110 has a thread inserting port 111 at one end, the thread discharging port 112 at the other end. A thread path is formed inside the thread pipe 110, and the looper thread T can be inserted through the thread path. The thread discharging port 112 is positioned at a rear end side of the looper groove 21*c* during a stitching operation. The air spraying unit 120 forwardly moves an air nozzle 121 (a nozzle) toward a spraying position P1 (see FIG. 13) at which the air nozzle 121 is opposed to the thread inserting port 111 of the thread pipe 110, and to supplies air to the thread inserting port 111. The switching mechanism 150 switches the connection and disconnection between the looper 21 and the looper driving shaft 22 when the looper 21 is at the front position. When the looper 21 is disconnected from the looper driving shaft 22 by the switching mechanism 150, the spring 153 moves the looper 21 to a rear position. The main shaft locking mechanism 160 positions the lower shaft 6 at a predetermined rotating angle at which the thread pipe 110 is placed at the front position through the looper driving shaft 22. The interlocking mechanism 170 moves the air nozzle 121 to the spraying position P1, brings the switching mechanism 150 into a disconnected state, and brings the main shaft locking mechanism 160 into an operable state.

Thread Guiding Means

As shown in FIGS. 1, 3, 5A and 5B, the thread pipe 110 is a tubular member curved at upper and lower portions in reverse directions respectively, and is formed in an S shape when seen from a side. As shown in FIG. 3, one end of the thread pipe 110 is formed with the thread inserting port 111 from which the looper thread T is inserted, and the other end of the thread pipe 110 is formed with the thread discharging port 112 from which the looper thread T is discharged. A diameter of the thread inserting port 111 is gradually increased toward the end in order to easily insert the looper thread T. An end portion of the thread discharging port 112 is bent toward a side of the looper 21. During the stitching operation, the thread discharging port 112 of the thread pipe 110 is disposed at a rear end side of the thread groove 21*c* of the looper 21, i.e., at an opposite side of the extended portion 21*a* of the looper 21 with respect to the thread hole 21*b*.

The thread pipe 110 is fixed to a side surface of the thread guide plate 113 which is fixed to the looper driving arm 24. When the looper support arm 23 is coupled to the looper driving arm 24, the thread pipe 110 is swiveled together with the looper 21 and interlockingly with the looper driving shaft 22, and is reciprocated between the front position shown in FIGS. 5A and 5B and a rear position (not shown).

Air Supplying Means

The air spraying unit 120 includes the air nozzle 121, an air pump 130, and an air spray moving mechanism 140. The air nozzle 121 sprays air toward the thread inserting port 111 into the thread pipe 110, and generates an air flow inside the thread pipe 110. The air pump 130 supplies the air to the air nozzle 121. The air spray moving mechanism 140 moves the air spraying unit 120 in order to move the air nozzle 121 between the spraying position P1 (see FIG. 13) which is close to the thread inserting port 111, and a standby position P2 (see FIG. 13) which is placed apart from the spraying position P1. When the thread hole 21*b* of the looper 21 and the thread discharging port 112 become coincident with each other by means of the interlocking mechanism 170, the air nozzle 121 of the air spraying unit 120 is moved to the spraying position P1 so as to be opposed to the thread inserting port 111.

As shown in FIG. 1, the threading device 100 is provided with the thread groove 8 (thread introducing means) having a thread path through which the looper thread T is inserted thereinside. One end of the thread groove 8 is opened to an outer side of the frame 2, and the other end is opened above an air outlet 121*a* of the air nozzle 121. The looper thread T inserted from the end opened to the outer side of the frame 2 and drawn out from the other end is inserted into the thread inserting port 111 by spraying pressurized air from the air outlet 121*a* on the tip of the air nozzle 121.

The air pump 130 includes an extensible and hollow bellows portion 131, and a lever portion 132 connected to one end of the bellows portion 131 and operable to compress the bellows portion 131. The other end of the bellows portion 131 is connected to the air nozzle 121 through an air tube 133. Namely, in the air pump 130, the lever portion 132 is operated to compress the bellows portion 131 so that the air inside the bellows portion 131 is sent to the air nozzle 121 through the air tube 133, whereby the air is discharged from the air outlet 121*a* at the tip of the air nozzle 121.

Figure 2:
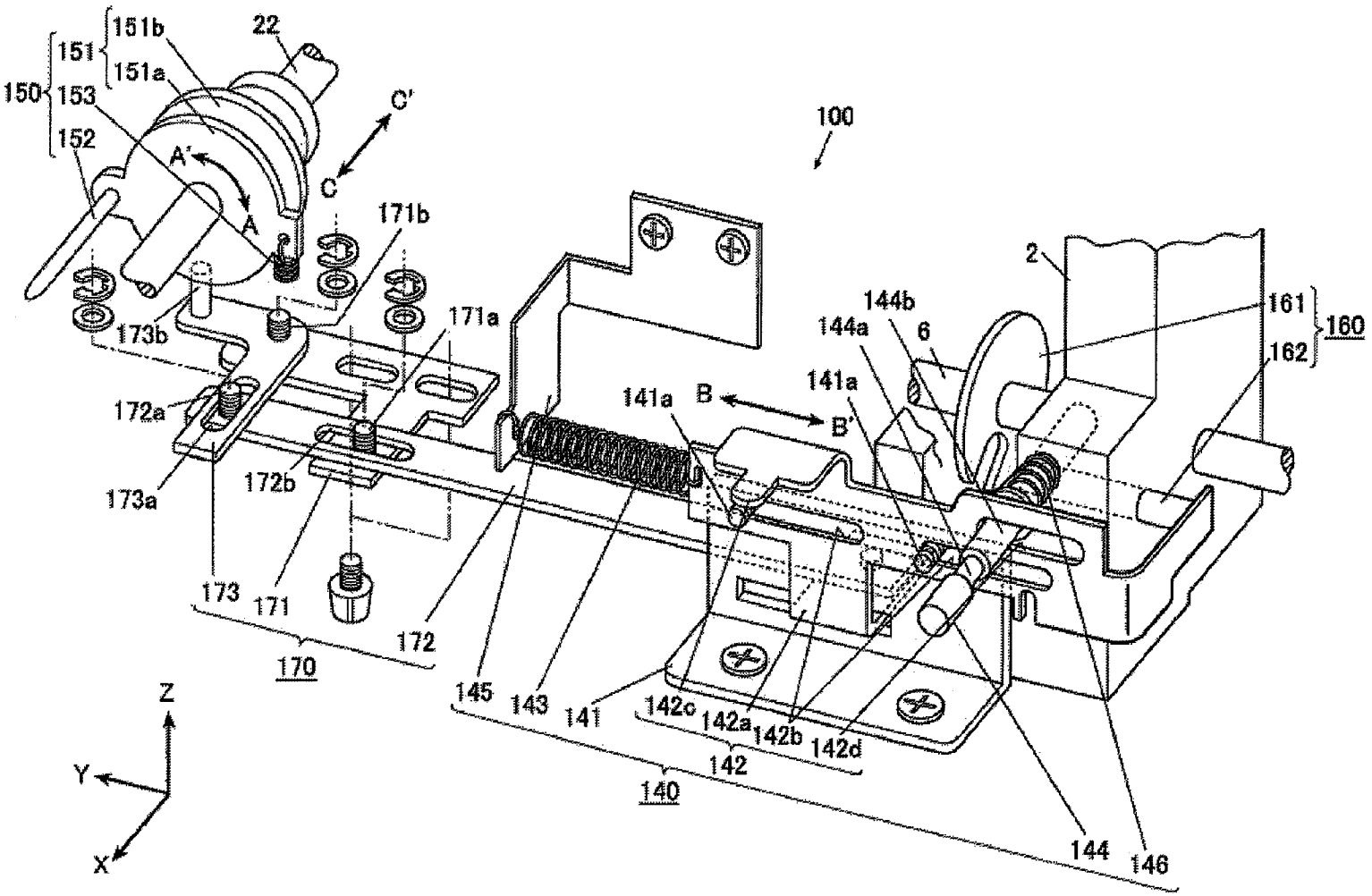
FIG. 2 is an exploded perspective view showing a part of a threading device according to a first exemplary embodiment of the invention.

As shown in FIG. 2, the air spray moving mechanism 140 includes an operating plate 142 on which the air nozzle 121 is supported such that the air nozzle 121 is movable between the spraying position P1 and the standby position P2, an operating plate base 141 which is fixed to the frame 2 and supports the operating plate 142, a spring 143 (nozzle biasing means) which biases the air nozzle 121 toward the spraying position P1, and a lock button 144 (operation input means, an operating member) which, when manually operated by an operator from outside the sewing machine 1, moves (displaces) the air nozzle 121 to the spraying position P1, brings the switching mechanism 150 into a disconnected state, and brings the main shaft locking mechanism 160 into an operable state.

One end of the operating plate base 141 is fixed to a bottom surface in the bed portion 2*b* with a screw, and the other end is bent upward at almost 90 degrees so as to be in parallel to a Y-Z plane. The operating plate base 141 has two projections 141*a* which are protruded in the X-axis direction and are arranged along the Y-axis direction. Each of the projections 141*a* is engaged with respective slots 142*b* of the operating plate 142, whereby the air spraying unit 120 is slidably supported in the Y-axis direction.

The air nozzle 121 is attached to the operating plate 142 along its moving direction, i.e., the Y-axis direction. The operating plate 142 includes a bent portion 142*a* at its lower end which is bent toward an inner side of the sewing machine 1 and is extended in the X-axis direction, and an operation lever 142*c* which moves the air spraying unit 120 in accordance with a manual operation of the operator. The operating plate 142 is formed with the two slots 142*b* extending along the Y-axis direction, and a slit 142*d* which allows the lock button 144 to switch the moving and the stopping of the operating plate 142.

One end of a release link 172 of the interlocking mechanism 170 is rotatably coupled to a tip portion of the bent portion 142*a* (see FIGS. 2 and 6).

The slots 142*b* are engaged with the respective projections 141*a* of the operating plate base 141 such that the operating plate 142 is slidable in the Y-axis direction, and such that the air nozzle 121 supported on the operating plate 142 is movable between the spraying position P1 and the standby position P2.

The operation lever 142*c* is bent in the X-axis direction at an upper end of the operating plate 142 and is extended toward a front side of the sewing machine 1, i.e., toward a side of an operating position of the operator. The operation lever 142*c* is engaged with a lever groove 9 formed on the frame 2 so as to be movable in the Y-axis direction. By manipulating the operation lever 142*c*, the operator can move the air spraying unit 120 in the Y-axis direction.

The slit 142*d* includes a holding portion 142*da* and a permitting portion 142*db* having a smaller diameter than the holding portion 142*da*. When a large diameter portion 144*b* of the lock button 144 is inserted into the holding portion 142*da*, the air nozzle 121 supported on the operating plate 142 is held at the standby position P2 against a biasing force of the spring 143. The permitting portion 142*db* has a smaller width than the holding portion 142*da* allows only a small diameter portion 144*a* of the lock button 144 to move in the Y-axis direction therethrough, thereby permitting the movement of the air nozzle 121 supported on the operating plate 142 toward the spraying position P1. The holding portion 142*da* of the slit 142*d* is provided on a side of an end the permitting portion 142*db* at the spraying position P1 side (a left end in FIG. 2).

One end in the Y-axis direction of the operating plate 142 is bent almost perpendicularly along the X-axis direction toward a side of the lower shaft 6, and holds a lock shaft 162 of the main shaft locking mechanism 160. This lock shaft 162 and the lock button 144 (operation input means) restricts a movement of the operating plate 142 in the X-axis and Z-axis directions. Thus, the operating plate 142 is movable only in the Y-axis direction.

One end of the spring 143 is coupled to one end of the operating plate 142 (a left end in FIG. 2), and the other end is coupled to one end of a holding member 145 fixed inside the bed portion 2*b* of the frame 2 with a screw. The spring 143 is a tension spring which is stronger than a coil spring 154 of the switching mechanism 150, and the operating plate 142 is constantly biased in a direction B shown in FIG. 2 by an elastic force of the spring 143.

The lock button 144 is a rod-shaped member disposed such that a longitudinal direction thereof is arranged along the X-axis direction. As shown in FIGS. 2 and 6, one end of the lock button 144 is protruded toward the front side of the sewing machine 1, i.e., a side of the working position the operator, through the slit 142*d* of the operating plate 142. The other end of the lock button 144 is inserted into the frame 2 in the X-axis direction, and is provided slidably along its axial direction A position of the lock button 144 can be switched between a holding position at which the air nozzle 121 of the air spraying mechanism 120 is held at the standby position P2 against the biasing force of the spring 143 and a permitting position at which the movement of the air nozzle 121 of the air spraying mechanism 120 to the air spraying position P1 due to the biasing force of the spring 143 is permitted. The small diameter portion 144*a*, which is engagable with the permitting portion 142*db* of the slit 142*d* so as to be slidable in the Y-axis direction, and the large diameter portion 144*b*, which is engagable with the holding portion 142*da* so as to be slidable in the X-axis direction, are formed on one side of the lock button 144.

A flange portion 144*c* is provided at a central part in the longitudinal direction of the lock button 144, and a coil spring 146 (a compression spring) is provided between the flange portion 144*c* and the frame 2. Namely, the lock button 144 is constantly biased toward the front side of the sewing machine 1 by an elastic force of the coil spring 146. When the large diameter portion 144*b* is inserted into the holding portion 142*da*, the flange portion 144*c* is held in an engaging state against an end face of the operating plate 142. On the other hand, when the lock button 144 is pushed toward the side of the frame 2 against the biasing force of the coil spring 146 by the operation of the operator, the small diameter portion 144*a* of the lock button 144 becomes movable along the permitting portion 142*db* of the slit 142*d*. As a result, the air nozzle 121 supported on the operating plate 142 is moved toward the spraying position P1 by the biasing force of the spring 143. When the small diameter portion 144*a* is engaged with the permitting portion 142*db* of the slit 142*d*, the large diameter portion 144*b* is engaged with the end face of the operating plate 142.

Switching Mechanism

The switching mechanism 150 is for disconnecting (separating) the looper 21 from the looper shaft 22 when the looper 21 and the thread pipe 110 are at their front positions. As shown in FIGS. 2 to 4, the switching mechanism includes a release slide base 151 fitted around the looper driving shaft 22, the release pin 152 (a coupling member) which is protruded from one end face of the release slide base 151, the spring 153 which biases the release slide base 151 in one rotating direction, and the coil spring 154 which biases the release slide base 151 in the axial direction. The release pin 152 is movable in the axial direction of the looper shaft 22. The release pin 152 can couple or break the connection between the looper support arm 23 and the looper driving arm 24 when it is moved while the looper 21 and the thread pipe 110 are placed at their front positions.

As shown in FIGS. 3 and 4, the release slide base 151 is a cylindrical member, and includes flange portions 151*a* and 151*b* at respective ends thereof. The flange portions 151*a* and 151*b* have larger diameters than an intermediate portion thereof. The release slide base 151 is disposed on an opposite side of the looper driving arm 24 with respect to the looper support arm 23 interposed therebetween. The release slide base 151 is rotatably fitted to the looper driving shaft 22, and is movable in the axial direction. The release pin 152 is protruded from the flange portion 151*a* which is close to the looper support shaft 23, and the spring 153 is coupled to the flange portion 151*a*.

A projection 173*b* of a release driving arm 173 of the interlocking mechanism 170 is engaged between the flange portions 151*a* and 151*b* from below. The projection 173*b* is movable in the X-axis direction so as to be able to abut against a lower portion of an end face of the flange portion 151. The flange portion 151*b* functions as a power transmitting portion which transmits a moving force in a direction C' to the release slide base 151 from the projection 173*b* of the interlocking mechanism 170. The projection 173*b* is moved in the X-axis direction (directions C-C') in accordance with an operation of the interlocking mechanism 170. A gap between the flange portions 15*la* and 151*b* may be provided such that the projection 173*b* abuts against the end face of the flange portion 151*b* only when the projection 173*b* moves in the direction C' and such that the projection 173*b* separates from the end face of the flange portion 151*b* when the projection 173*b* moves in the direction C.

The release pin 152 (the switching member) is provided in the vicinity of the edge of the flange portion 151*a* on a left side in a horizontal direction from the looper driving shaft 22 when seen in the direction D shown in FIG. 3. The release pin 152 is protruded in parallel to the looper driving shaft 22 toward a side of the looper support arm 23 from the end face of the flange portion 151*a* facing the looper support arm 23. A length of the release pin 152 is set such that a tip portion of the release pin 152 is inserted into the slot 24*a* of the looper driving arm 24 via the slot 23*a* of the looper support arm 23 when the end face of the flange portion 151*a* is in contact with the looper support arm 23 (see FIG. 4A), and such that the tip portion of the release pin 152 is disengaged from the looper driving arm 24 and is engaged only with the looper support arm 23 when the release slide base 151 is slid in the direction C' shown in FIG. 3 by the interlocking mechanism 170 (see FIG. 4B). Namely, the release pin 152 has a function of switching the interlocking and releasing of the looper driving shaft 22 and the looper 21 by switching the connection and disconnection of the looper support arm 23 and the looper driving arm 24.

One end (an upper end) of the spring 153 (an acting member) is coupled to an edge portion of the flange portion 151*a* on the opposite side of the release pin 152 interposing the looper driving shaft 22 therebetween. The other end (a lower end) of the spring 153 is coupled to the inner bottom surface of the bed portion 2*b* of the frame 2. The spring 153 is a tension spring, and constantly biases the release slide base 151 around the looper driving shaft 22 in one rotating direction, i.e., a rearward moving direction of the looper 21 (a direction A shown in FIG. 3).

The coil spring 154 is provided on the opposite side of the looper support arm 23 interposing the release slide base 151 therebetween. The coil spring 154 is fitted around the outer surface of the looper driving shaft 22. One end of the coil spring 154 is engaged with the end face of the flange portion 151*b* and the other end is engaged with an end face of a flange 22*a* fixed to the looper driving shaft 22. Namely, the coil spring 154 constantly biases the release slide base 151 toward the looper support shaft 23 (in the direction C shown in FIGS. 3 and 4).

When the release slide base 151 is disposed on a side of the direction C, i.e., a side of the looper support arm 23 so that the release pin 152 is inserted into the slot 24*a* of the looper driving arm 24 (see FIG. 4A), the looper 21 is swiveled in synchronization with the rotation of the looper driving shaft 22. On the other hand, when the release slide base 151 is disposed on a side of the direction C' so that it is separated from the looper support arm 23 (see FIG. 4B), the looper driving arm 24 and the looper support arm 23 are disconnected from each other. Thus, the looper 21 is tilted in the rearward moving direction through the release slide base 151, the release pin 152 and the looper support arm 23 by the biasing force of the spring 153, whereby the looper 21 is disposed at one end of the swiveling motion thereof, i.e., a rearmost moving position (a rear position) in the back and forth movement (see FIG. 5B). When the looper 21 is tilted to the rear position, the thread hole 21*b* of the looper 21 and the thread discharging port 112 of the thread pipe 110 becomes coincident with each other. This rearmost moving position is a threading position according to the first exemplary embodiment.

Main Shaft Locking Mechanism

As shown in FIGS. 2, 6A, 6B and 6C, the main shaft locking mechanism 160 includes a main shaft lock plate 161 (a rotating member) having an engaging portion 161*a* (an opening portion) and is fixed to the lower shaft 6, the lock shaft 162 (a lock member) which is engagable with the engaging portion 161*a* to stop the lower shaft 6 at a predetermined rotating angle, and lock member biasing means for biasing the lock shaft 162 in a direction in which the lock shaft 162 engages with the engaging portion 161*a*. In the first exemplary embodiment, the spring 143 functions as the lock member biasing means.

The main shaft lock plate 161 is rotated together with the lower shaft 6 by the driving operation of the motor 5. The engaging portion 161*a* is formed on a peripheral edge of the main shaft lock plate 161 such that the main shaft lock plate 161 is partially cut away.

The lock shaft 162 has a shape of a round bar. One end of the lock shaft is attached to one end of the operating plate 142 of the air spray moving mechanism 140. The lock shaft 162 is provided in parallel to the lower shaft 6, i.e., in the Y-axis direction. The other end of the lack shaft 162 penetrates the frame 2 from an outer side to an inner side thereof in the Y-axis direction, and is movable along its axial direction. The lock shaft 162 is moved in the Y-axis direction together with the operating plate 142 in accordance with the movement of the operating plate 142 in the Y-axis direction.

In the first exemplary embodiment, when the indicator m2 on an external surface of the frame 2 matches the indicator m1 of the flywheel 7, the lock shaft 162 can be fitted, in the axial direction, into the engaging portion 161*a* which opened in a groove shape by partially cutting away the main shaft lock plate 161. In other words, according to the main shaft locking mechanism 160 of the first exemplary embodiment, the lower shaft 6 is stopped (locked) by the lock shaft 162 at a rotating angle at which the looper 21, interlocking with the lower shaft 6, is at a foremost moving position in the back and forth movement (see FIG. 5A).

Interlocking Mechanism

The interlocking mechanism 170 of the sewing machine 1 according to the first exemplary embodiment will be described in detail with reference to the drawings.

The interlocking mechanism 170 includes the release driving arm 173 which moves the release slide base 151 of the switching mechanism 150 in the X-axis direction, a release link base 171 supporting the release driving arm 173 rotatably in a horizontal direction, and the release link 172 coupling the operating plate 142 of the air spray moving mechanism 140 and the release driving arm 173 (see FIG. 2).

As shown in FIG. 2, the release link 172 is formed from a long plate member, and is disposed in a lower part inside the bed portion 2*b*. A longitudinal direction of the release link 172 is extended along the Y-axis direction. One end of the release link 172 is rotatably coupled to the bent portion 142*a* of the operating plate 142. A projection 172*a* is upwardly provided (in the Z-axis direction) on the other end of the release link 172, and a slot 172*b* vertically penetrating in the longitudinal direction of the release link 172 (in the Y-axis direction) is formed near the projection 172*a*.

The release link base 171 is fixed, with a screw, to the bottom face in the bed portion 2*b* near the release slide base 151. One end of the release link base 171 is extended to a lower side of the slot 172*b* of the release link 172, and is provided with a projection 171*a* which is inserted into the slot 172*b* of the release link 172 in an upward direction. The other end of the release link base 171 is extended below the release driving arm 173, and is provided with a projection 171*b* in the upward direction.

The release driving arm 173 is a plate member having an L shape when seen on a plane. A bent portion at a central part of the release driving arm 173 is coupled to the projection 171*b* provided on the other end of the release link base 171, and is supported by the projection 171*b* so as to be rotatable in the horizontal direction. One end of the release driving arm 173 is formed with a slot 173*a* which vertically penetrates through the release driving arm 173 (in the Z-axis direction) and is extended in the X-axis direction. The projection 172*a* of the release link 172 is rotatably coupled into the slot 173*a*. The other end of the release driving arm 173 is provided with the projection 173*b* in the upward direction.

The release driving arm 173 converts the movement of the release link 172 in the Y-axis direction into a movement in the X-axis direction, and transmits this movement to the release slide base 151. More specifically, when the release link 172 is moved in the direction B along the Y-axis direction together with the operating plate 142, the release driving arm 173 is rotated around the projection 171*b* so that the projection 173*b* abuts on a lower end portion of the flange portion 151*b* of the release slide base 151. When the release link 172 is further moved in the direction B, the release slide base 151 is moved in the direction C' against the biasing force of the coil spring 154 in the direction C.

Namely, the operating plate 142 and the release slide base 151 are coupled to each other through the release link base 171, the release link 172 and the release driving arm 173. The movement of the operating plate 142 in the Y-axis direction and the movement of the release slide base 151 in the X-axis direction are interlocked with each other through the interlocking mechanism 170 including the release link base 171, the release link 172 and the release driving arm 173. According to this configuration, the main shaft locking mechanism 160, the switching mechanism 150 and the air spray moving means 140 are interlocked with each other so that the thread discharging port 112 of the thread pipe 110 disposed at the front position becomes coincident with the thread hole 21*b* of the looper 21 disposed at the rear position, and the thread inserting port 111 of the thread pipe 110 disposed at the front position becomes coincident with the tip of the air nozzle 121 disposed at the spraying position P1 in the vertical and horizontal directions.

Next, description will be given to an operation of the sewing machine 1 having the above configuration.

Tilting Operation of Looper

Figure 6A:
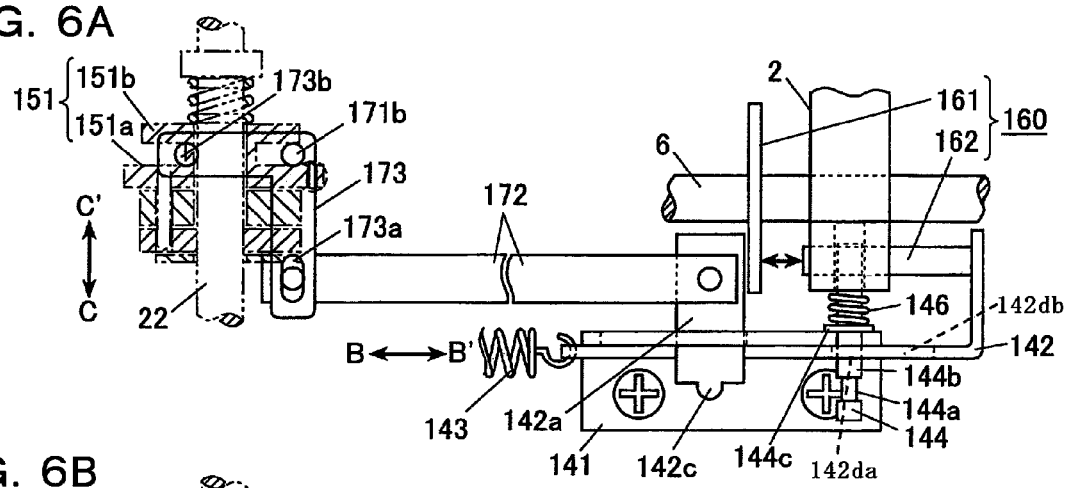
FIGS. 6A to 6C are schematic views of interlocking means according to the first exemplary embodiment, FIG. 6A illustrating a standby position, FIG. 6B illustrating a lock plate abutting position and FIG. 6C illustrating a main shaft locked state.

During the stitching operation, the operating plate 142 is disposed on a side of a direction B' as shown in FIG. 6A, and the large diameter portion 144*b* of the lock button 144 is engaged with the holding portion 142*da* of the slit 142*d* so that the operating plate 142 is positioned. The lock shaft 162 mounted on the operating plate 142 and the air nozzle 121 are also disposed on the side of the direction B'. Accordingly, the lower shaft 6 is unlocked, and the air nozzle 121 is disposed at the standby position P2. In this state, the release slide base 151 is disposed on a side of the direction C so that the looper driving arm 24 and the looper support arm 23 are coupled to each other through the release pin 152 (see FIG. 4A). In other words, the lower shaft 6 is rotatable in synchronization with the driving operation of the motor 5, and the looper 21 is swiveled in synchronization with the lower shaft 6. The stitching operation is carried out by a cooperation of the needles 4 and the looper 21.

When threading the looper thread T through the thread hole 21*b* of the looper 21, first, the flywheel 7 is rotated manually by the operator to cause the indicator m1 to be coincident with the indicator m2 in the state in which the sewing machine 1 is stopped. Consequently, the rotating angle of the lower shaft 6 is positioned at a predetermined rotating angle, i.e., an angle at which the looper 21 interlocking with the lower shaft 6 through the looper driving shaft 22 is at the foremost moving position in the back and forth movement (see FIG. 5A).

Subsequently, when the lock button 144 is manually pushed by the operator, the small diameter portion 144*a* of the lock button 144 becomes movable along the permitting portion 142*db* of the slit 142*d*.

Figure 6B:
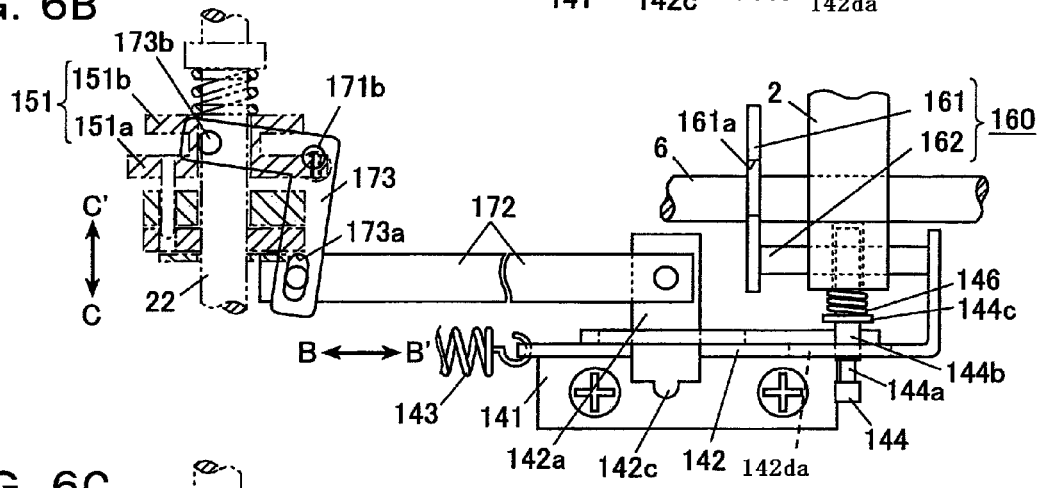
Figure 6C:
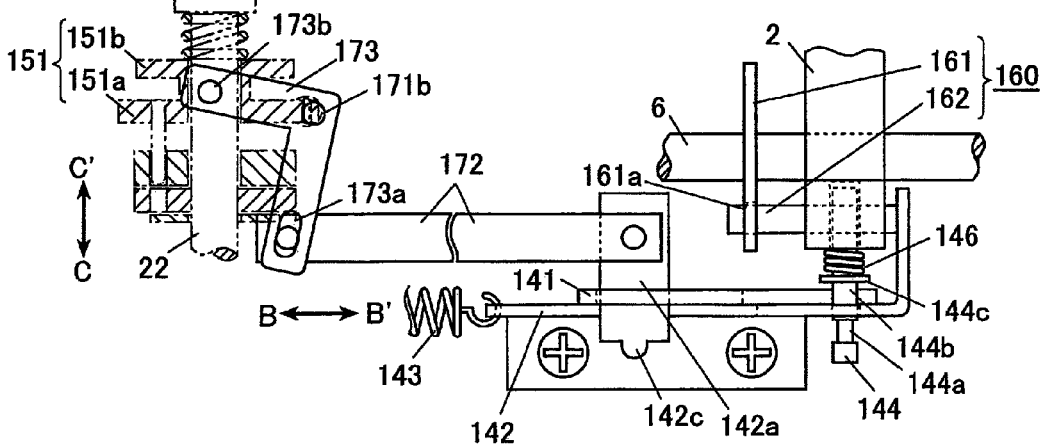

At this time, the operating plate 142 is moved in the direction B by the biasing force of the spring 143 so that the lock shaft 162 is moved in the direction B, whereby the tip portion thereof is inserted into the engaging portion 161*a* of the main shaft lock plate 161 (see FIG. 6C). Consequently, the rotation of the lower shaft 6 is restricted, whereby the lower shaft 6 is brought into a locked state.

When the lock button 144 is pushed when the indicator m1 is not coincident with the indicator m2, the tip portion of the lock shaft 162 abuts on the end face of the main shaft lock plate 161 as shown in FIG. 6B. However, when the flywheel 7 is further rotated from this state, the engaging portion 161*a* and the tip portion of the lock shaft 162 can be caused to become coincident with each other.

Inside the bed portion 2*b* below the needles 4, the release link 172 coupled to the operating plate 142 is moved in the direction B so that the release driving arm 173 is rotated around the projection 171*b* and the projection 173*b* is caused to abut on the flange portion 151*b* of the release slide base 151. Because the biasing force of the spring 143 is stronger than the biasing force of the coil spring 154, the release slide base 151 is moved in the direction C' against the biasing force of the coil spring 154 (see FIG. 4B).

Figure 4B:
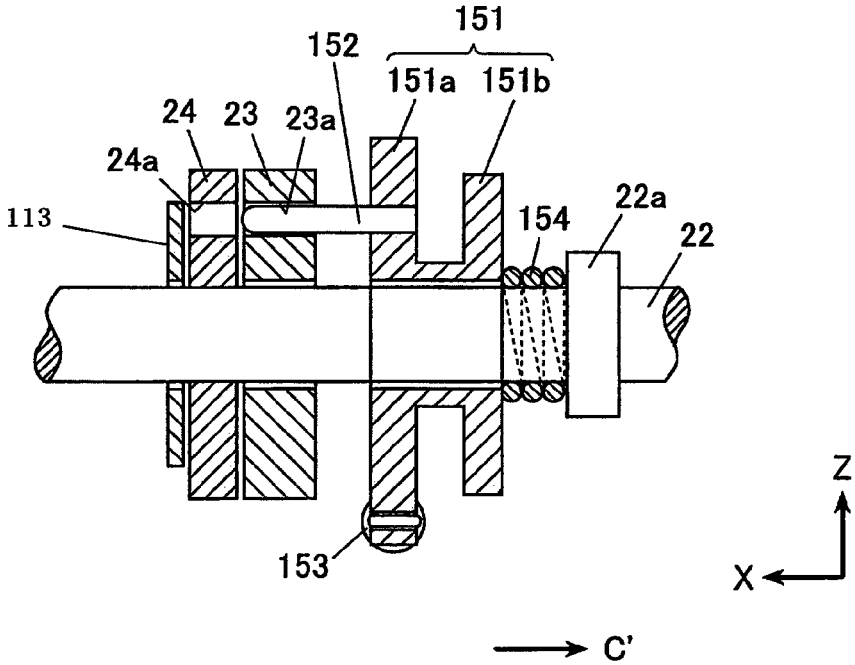

When the release slide base 151 is moved in the direction C', the tip portion of the release pin 152 is pulled out from the slot 24*a* of the looper driving arm 24, and is thus inserted only into the slot 23*a* of the looper support arm 23 (see FIG. 4B). In this state, the looper driving arm 24 and the looper support arm 23 are disconnected from each other. Accordingly, both the looper support arm 23 and the release slide base 151 are rotatable with respect to the looper driving shaft 22. Therefore, the release slide base 151 and the looper support arm 23 are rotated (tilted) in the direction A by the biasing force of the spring 153.

Figure 5B:
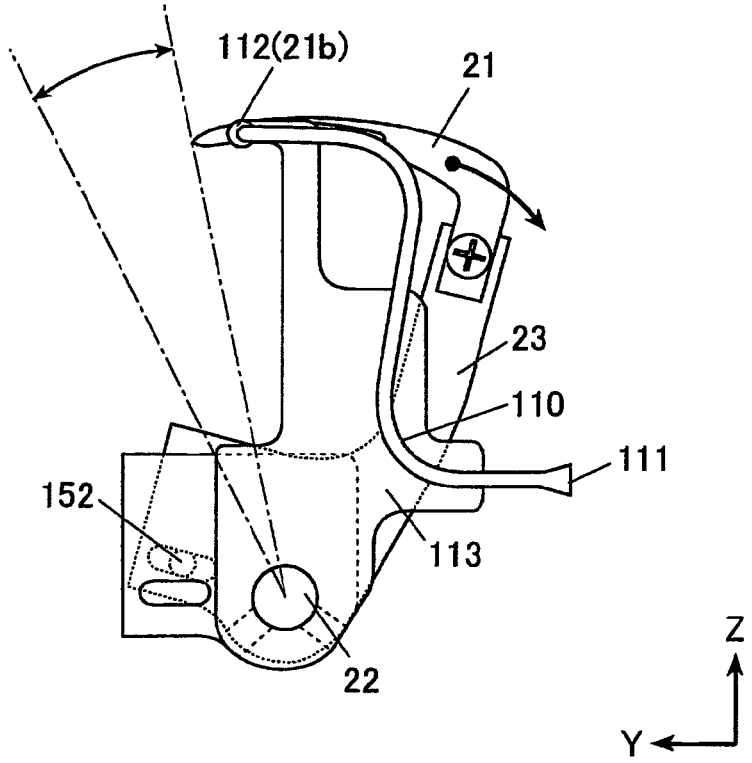

Due to this rotation, the looper 21 supported on the looper support arm 23 is disposed at the rear position so that the thread discharging port 112 of the thread pipe 110 becomes coincident with the thread hole 21*b* (see FIG. 5B). Then, the lever portion 132 of the air pump 130 is operated in this state so that the threading operation for inserting the looper thread T through the thread hole 21*b* of the looper 21 via the thread pipe 110 is carried out.

Returning Operation of Looper

When returning the looper 21 tilted at the rear position, the operation lever 142*c* is first manually operated by the operator to move the operating plate 142 in the direction B'. Consequently, the lock shaft 162 is moved in the direction B' so that the locked state of the lower shaft 6 is released. Therefore, the lower shaft 6 becomes rotatable (see FIG. 6A). The operating plate 142 is moved in the direction B' so that the release driving arm 173 is rotated through the release link 172. Consequently, the projection 173*b* is separated from the end face of the flange portion 151*b* so that the release slide base 151 becomes movable in the direction C. When the looper 21 is tilted at the rear position, the tip portion of the release pin 152 is not coincident with the slot 24*a* of the looper driving arm 24. Accordingly, the release slide base 151 is maintained to be biased in the direction C by the biasing force of the coil spring 154 and thus stands by in a state in which the tip portion of the release pin 152 abuts on a side face of the looper driving arm 24 facing the looper support arm 23 through the slot 23*a* of the looper support arm 23.

Subsequently, when the flywheel 7 is rotated manually by the operator, the looper driving shaft 22 is rotated interlockingly with the rotation of the lower shaft 6, and the looper driving arm 24 is swiveled interlockingly with the rotation of the looper driving shaft 22. When the looper driving arm 24 is swiveled to one end (the rearmost moving position in the back and forth movement of the looper 21), the slot 24*a* and the release pin 152 become coincident with each other so that the release slide base 151 is further moved in the direction C by the biasing force of the coil spring 154, whereby the release pin 152 is inserted into the slot 24*a*. Consequently, the looper driving arm 24 and the looper support arm 23 are coupled to each other through the release pin 152. Thus, the looper 21 and the lower shaft 6 are interlocked with each other, whereby it becomes possible to carry out the stitching operation.

As described above, according to the sewing machine 1 of the first exemplary embodiment, the main shaft locking mechanism 160, the switching mechanism 150 and the air spraying unit 120 are interlocked with each other by a single operation (i.e., without separate operations). When the lock button 144 is simply operated, the air nozzle 121 of the air spraying unit 120 can be moved to the spraying position P1 and the lower shaft 6 can be locked at the predetermined rotating angle. Furthermore, the looper 21 can be positioned at the rear position through the interlocking mechanism 170. Therefore, the operator of the sewing machine 1 does not need to use both hands in order to operate each of the mechanisms. In other words, it is possible to implement, by one hand, the alignment of the lower shaft 6, the lock/release of the lower shaft 6, the movement of the air nozzle 121, the tilt of the looper 21 and their returning operations. Consequently, the threading work is considerably simplified facilitated. Thus, the operability of the sewing machine 1 is significantly improved. In addition, the looper 21 is tilted to the rear position when matching the thread discharging port 112 of the thread pipe 110 and the thread hole 21*b* of the looper 21. Therefore, it is possible to carry out the threading work with a simple structure without requiring to pull away the thread passing through the looper 21 or to release the tension of the thread.

SECOND EXEMPLARY EMBODIMENT

Next, a second exemplary embodiment of the invention will be described in detail with reference to FIGS. 7 and 8. In the following exemplary embodiments, the structures that are the same as those in the first exemplary embodiment have will be labeled with the same reference numerals, and repetitive description thereof will be omitted.

The second exemplary embodiment is different from the first exemplary embodiment in that a lever 244 (operation input means, a manual operating portion) and a main shaft locking mechanism 260 which is driven by the lever 244 are provided.

As shown in FIG. 8, the lever 244 is supported on a frame 2 rotatably in a horizontal direction through a shaft 244*a* in a middle in a longitudinal direction thereof. One end of the lever 244 is protruded from a lever groove 9 (see FIG. 1) provided on a side surface of a bed portion 2*b* of the frame 2 in the Y-axis direction to a working position side of an operator (this side of the paper in FIG. 1) (not shown) and can be operated in the Y-axis direction manually by the operator. The other end of the lever 244 is provided with a slot 244*b* penetrating through the lever 244 vertically in a longitudinal direction.

As shown in FIGS. 7 and 8, the main shaft locking mechanism 260 according to the second exemplary embodiment includes a main shaft lock plate 261 fixed to a lower shaft 6, a link member 263 having an L shape which rotates in a horizontal plane around a fulcrum shaft 262 fixed inside the bed portion 2*b* in accordance with an input operation from the lever 244, and a lock member 264 superposed on the link member 263 rotatably in the horizontal plane around the fulcrum shaft 262 in the same manner.

Figure 7A:
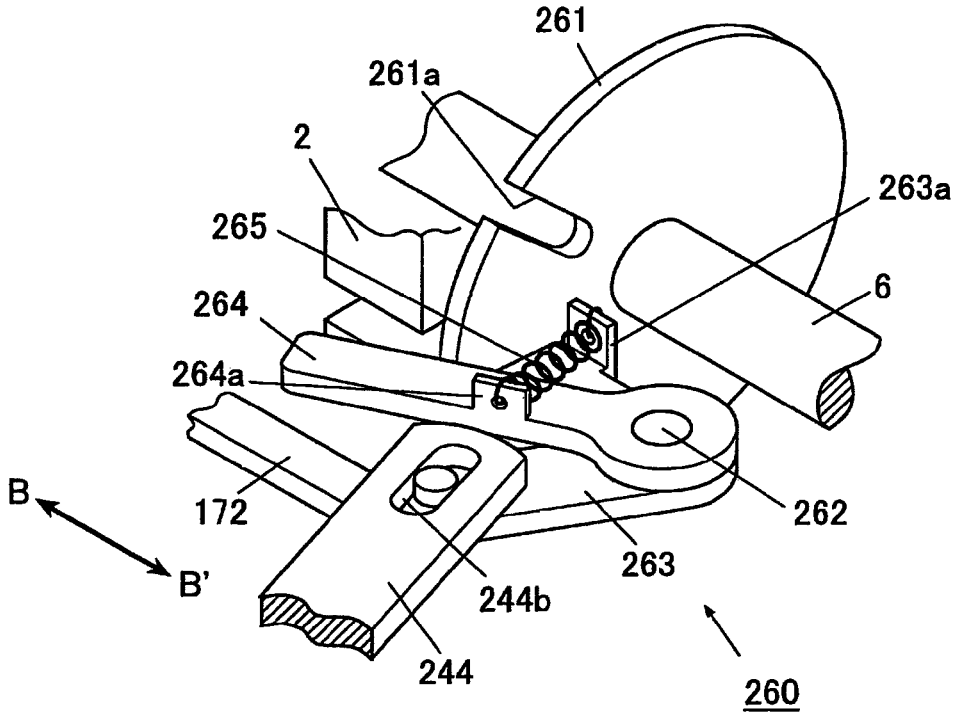
FIGS. 7A and 7B are schematic perspective views of a main shaft locking mechanism according to a second exemplary embodiment of the invention, FIG. 7A illustrating a lock plate abutting position and FIG. 7B illustrating a main shaft locked state.
Figure 7B:
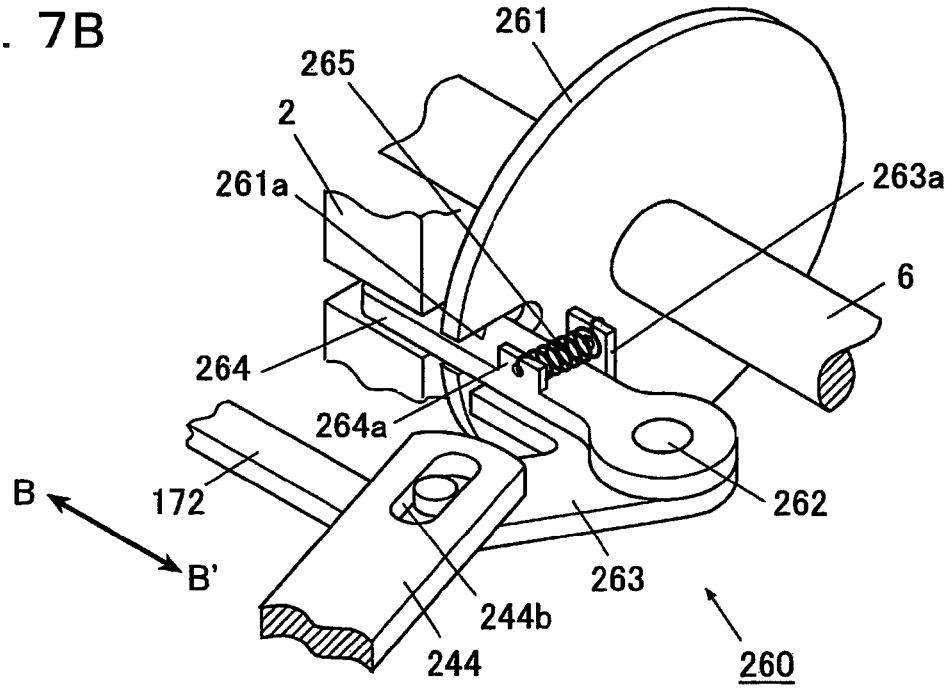

As shown in FIGS. 7A and 7B, a slit 261*a* to be an engaging portion with which the plate-shaped lock member 264 is engaged in a radial direction is provided in a part of an outer periphery of the main shaft lock plate 261. In the same manner as in the first exemplary embodiment, the slit 261*a* is provided at a predetermined rotating angle of the lower shaft 6 (the main shaft), i.e., an angle at which indicators m1 and m2 are coincident with each other and the lock member 264 can be engaged when a looper 21 to be interlocked with the lower shaft 6 is disposed in a front position in a back and forth movement thereof (see FIG. 5A) in the same manner as in the first exemplary embodiment.

The link member 263 has an L shape, and is supported rotatably by the support shaft 262 fixed to the frame 2 in a bent portion having an L shape. As shown in FIGS. 7 and 8, one end of the link member 263 is rotatably coupled to one end of a release link 172 and the other end of the lever 244, and a spring hook 263*a* is provided on the other end of the link member 263 (see FIG. 7A). When the release link 172 is moved in a direction B by an operation of the lever 244, the link member 263 is rotated around the support shaft 262 and the other end thereof is disposed in almost parallel with the lower shaft 6. The other end of the link member 263 is set to have such a length as not to come in contact with the main shaft lock plate 261 when the link member 263 is rotated around the fulcrum shaft 262 (see FIG. 8B).

The lock member 264 is a plate-shaped member which is rotated in a horizontal plane around the fulcrum shaft 262 and is fitted, in a radial direction, in the slit 261*a* of the main shaft lock plate 261 (a rotating member), and is set to have such a length as to be engageable with an inner part of the slit 261*a* of the main shaft lock plate 261 when it is rotated around the fulcrum shaft 262 and is thus disposed in parallel with the lower shaft 6. A spring hook 264*a* is provided on one of sides of the lock member 264. One end of a tension spring 265 (lock member biasing means) having the other end coupled to the spring hook 263*a* of the link member 263 is coupled to the spring hook 264*a*. In other words, the lock member 264 and the link member 263 form a two-layer structure in which they can be rotated coaxially and separately. The lock member 264 is constantly biased toward the spring hook 263*a* side positioned on one of the ends of the link member 263 by a biasing force of the tension spring 265 and is thus disposed on the spring hook 263*a* side.

The release link 172 coupled to the link member 263 is coupled to an operating plate 142 and can be moved in the Y-axis direction together with the operating plate 142 in the same manner as in the first exemplary embodiment. In the second exemplary embodiment, the operating plate 142 can also be operated by the lever 244 in the direction B and a direction B'. Therefore, it is not necessary to always provide the operating portions such as the lock button 144 and the operation lever 142*c*, and the spring 143 (the nozzle biasing means) of the first exemplary embodiment.

Figure 8A:
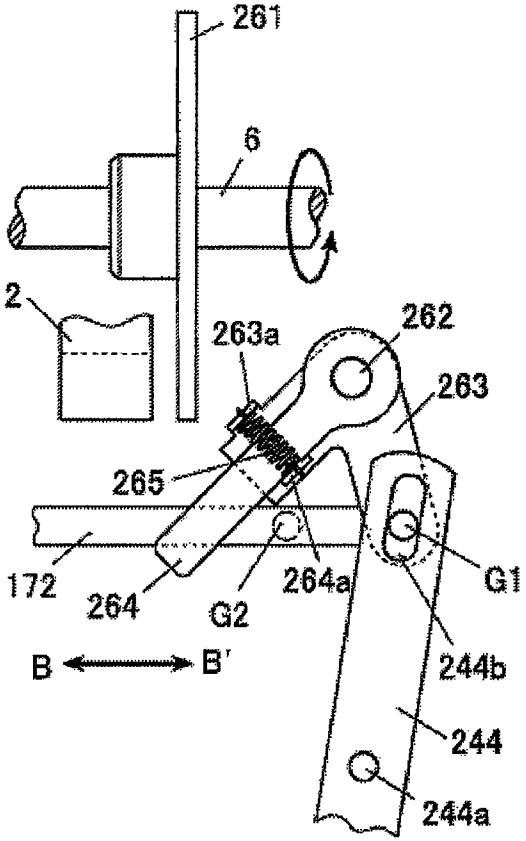
FIGS. 8A to 8C are views illustrating operations of the main shaft locking mechanism, FIG. 8A illustrating a standby position, FIG. 8B illustrating the lock plate abutting position and FIG. 8C illustrating the main shaft locked state.
Figure 8B:
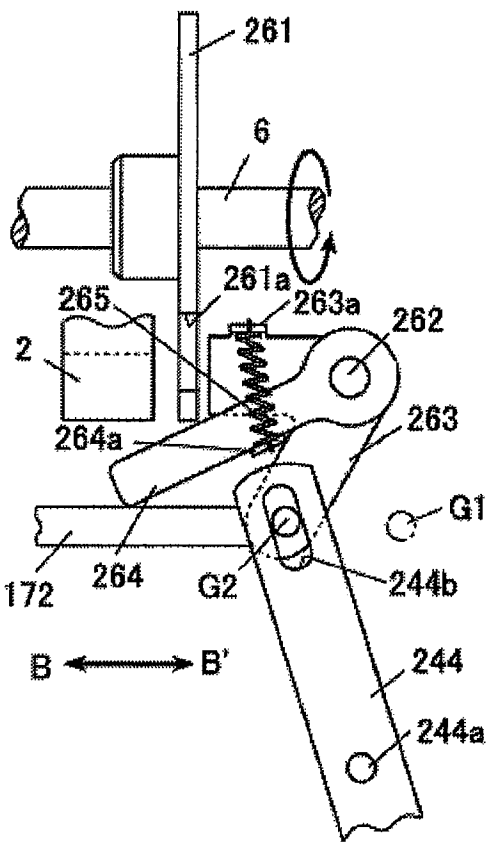

As shown in FIG. 8A, when the lever 244 is disposed in the direction B, the release link 172 is disposed in the direction B' so that a coupling point is disposed on G1 shown in FIG. 8. At this time, both the link member 263 and the lock member 264 are separated from the main shaft lock plate 261 and the lower shaft 6 becomes rotatable as shown in FIG. 8A. When one end of the lever 244 is moved in the direction B' manually by the operator, then, the lever 244 is rotated in a counterclockwise direction in FIG. 8 around the shaft 244*a*. Consequently, the release link 172 is moved in the direction B so that the coupling point is disposed on G2 shown in FIG. 8.

Figure 8C:
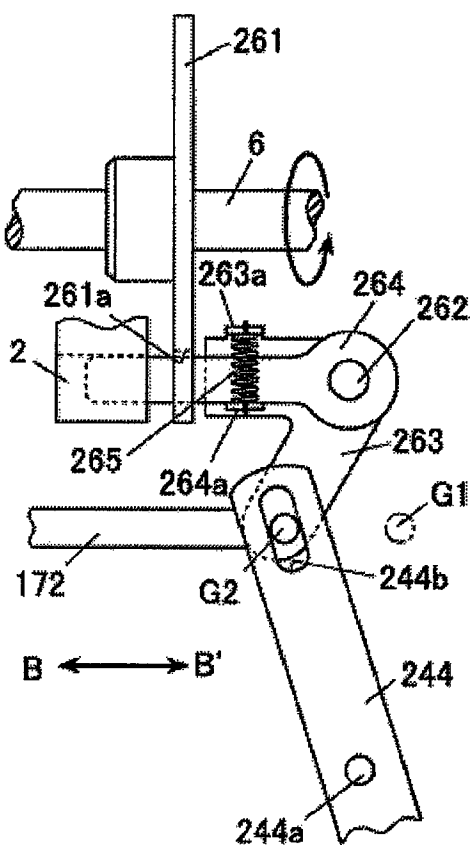

When the lower shaft 6 is positioned at the predetermined rotating angle at which the indicators m1 and m2 are coincident with each other, both the link member 263 and the lock member 264 are disposed in parallel with the lower shaft 6 so that the lock member 264 is fitted in the slit 261*a* of the main shaft lock plate 261 to bring a state in which the rotation of the lower shaft 6 is locked as shown in FIG. 8C. On the other hand, when the lever 244 is moved in the direction B' in the case in which the rotating angle of the lower shaft 6 is an angle other than the predetermined rotating angle at which the indicators m1 and m2 are coincident with each other, the lock member 264 abuts on an edge other than the slit 261*a* over the outer periphery of the main shaft lock plate 261 and only the link member 263 is disposed parallel to the lower shaft 6 as shown in FIG. 8B. In this state, the lock member 264 is maintained with a tip thereof energized toward a central side of the main shaft lock plate 261 by the biasing force of the tension spring 265. When the lower shaft 6 is rotated to have the predetermined rotating angle in this state, the lock member 264 is fitted in the engaging portion 261*a* so that the rotation of the lower shaft 6 is locked (see FIG. 8C). When the locked state of the lower shaft 6 is to be released, the lever 244 is moved in the direction B manually by the operator so that the release link 172 is moved in the direction B' and the coupling point is thus moved to G1 shown in FIG. 8. Then, the link member 263 and the lock member 264 are rotated in such a direction that they are separated from the main shaft lock plate 261. Thus, the locked state of the lower shaft 6 is released (see FIG. 8A).

In the sewing machine according to the second exemplary embodiment, it is possible to interlock the main shaft locking mechanism 260, a switching mechanism 150 and an air spray moving mechanism 140 by a single operation (i.e., without operating them separately) in the same manner as in the first exemplary embodiment. Therefore, a threading work can be simplified considerably and carried out easily. In the same manner as in the first exemplary embodiment, moreover, the operator can carry out an operation by one hand.

THIRD EXEMPLARY EMBODIMENT

Next, description will be given to a third exemplary embodiment of the invention. As shown in FIG. 9, a main shaft locking mechanism 360 according to the third exemplary embodiment includes a motor starting switch 361 (motor driving input means), a motor stopping switch 362 (detecting means) which detects that the main shaft locking mechanism 360 positions a lower shaft 6 at a predetermined rotating angle, and a control portion 350 (motor control means) which inputs a start of a rotating and driving operation to a motor 5 when the main shaft locking mechanism 360 is brought into an operable state in accordance with an input operation from a lock button 144 (operation input means), and inputs a stop of the rotating and driving operation of the motor 5 when the lower shaft 6 is positioned at the predetermined rotating angle differently from the first and second exemplary embodiments.

Figure 9A:
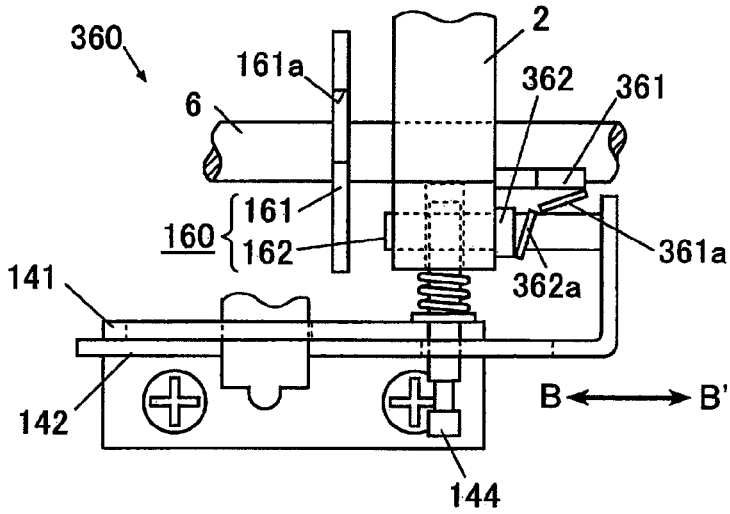
FIGS. 9A to 9C are views illustrating operations of a main shaft locking mechanism according to a third exemplary embodiment, FIG. 9A illustrating a standby position, FIG. 9B illustrating a lock plate abutting position and FIG. 9C illustrating a main shaft locked state.
Figure 9B:
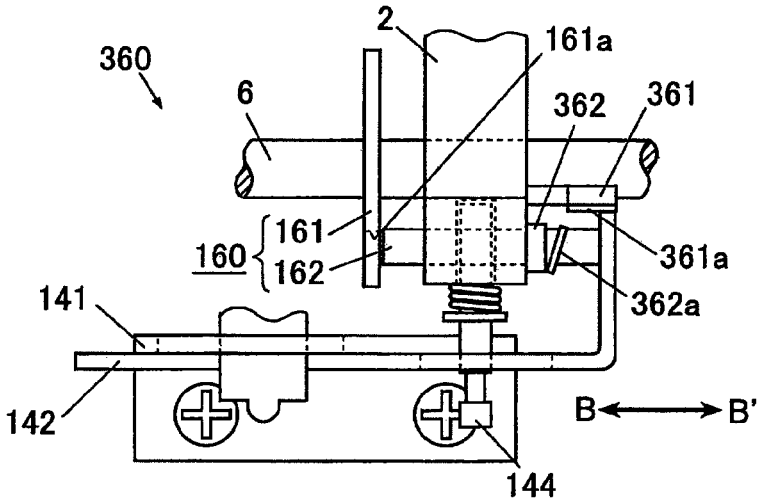
Figure 9C:
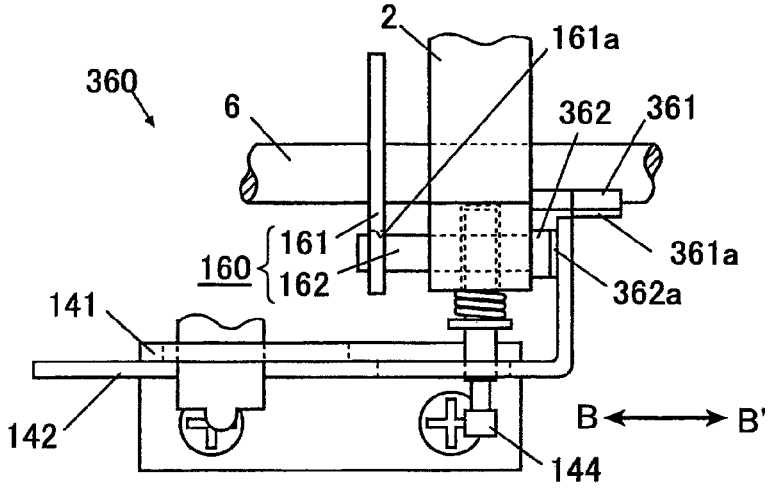

The motor starting switch 361 can carry out ON/OFF switching by opening/closing a detecting portion 361*a*, and serves to output a signal for driving the motor 5 to a control portion (not shown) in an ON state in which the detecting portion 361*a* is pushed. The motor starting switch 361 is fixed to a frame 2 in a state in which the ON/OFF switching can be carried out by a movement of an operating plate 142 in a Y-axis direction as shown in FIGS. 9A to 9C, for example. When the operating plate 142 and a lock shaft 162 are disposed in a B' direction, that is, a standby position shown in FIG. 9A, there is brought the OFF state in which the detecting portion 361*a* is opened. When the operating plate 142 is stopped in a state in which a tip of the lock shaft 162 abuts on an end face of a main shaft lock plate 161 as shown in FIG. 9B, the detecting portion 361*a* is pushed so that the motor starting switch 361 is turned ON.

On the other hand, the motor stopping switch 362 can carry out the ON/OFF switching by opening/closing a detecting portion 362*a* and serves to output a signal for stopping the motor 5 to the control portion (not shown) in an ON state in which the detecting portion 362*a* is pushed. The motor stopping switch 362 is fixed to the frame 2 such that the ON operation is carried out in only a state in which the tip of the lock shaft 162 is engaged with an engaging portion 161*a* of the main shaft lock plate 161 by the movement of the operating plate 142 in the Y-axis direction (see FIG. 9C) and the OFF operation is carried out in the other positions (see FIGS. 9A and 9B).

Figure 11:
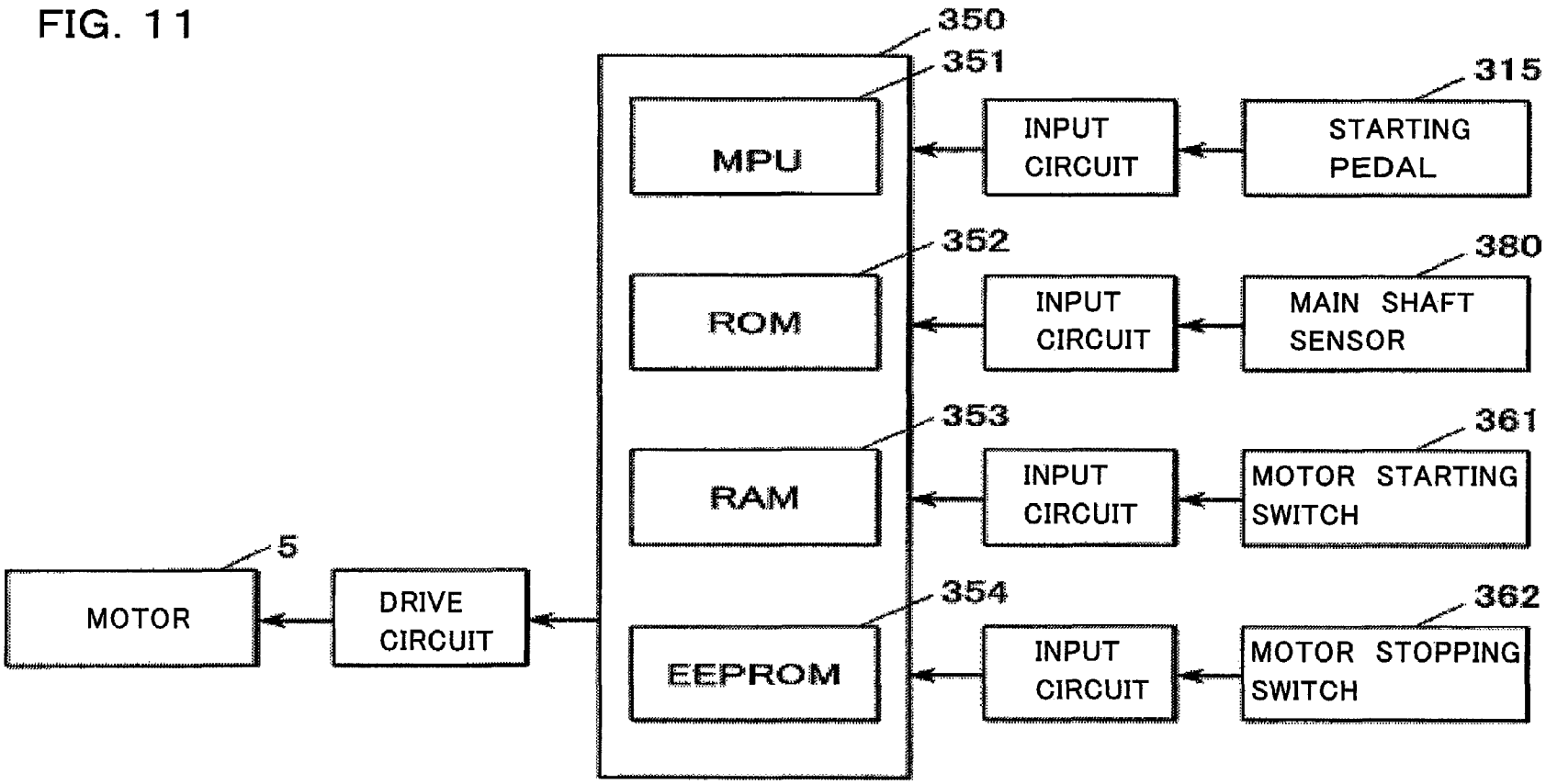
FIG. 11 is a control block diagram showing a structure of a control portion according to the third exemplary embodiment.

As shown in FIG. 11, the control portion 350 is a microcomputer including an MPU 351, an ROM 352, an RAM 353 and an EEPROM 354. Signals output from a starting pedal 315, a main shaft sensor 380 (see FIG. 10), the motor starting switch 361 and the motor stopping switch 362 are sent to an input side of the MPU 351. A driving circuit which drives the motor 5 is coupled to an output side of the MPU 351.

The control portion 350 serves to decide that the main shaft locking mechanism 360 is set in an operable state when the lock shaft 162 is moved in a direction B in accordance with the input operation from the lock button 144 (the operation input means) and the motor starting switch 361 is thus turned ON, thereby inputting a start of the rotating and driving operation of the motor 5. Moreover, the control portion 350 carries out a control processing of deciding that the lower shaft 6 is positioned at the predetermined rotating angle by the ON operation of the motor stopping switch 362 through the movement of the lock shaft 162 in the direction B, thereby inputting the stop of the rotating and driving operation of the motor 5.

Description will be given to an operation of the main shaft locking mechanism 360 according to the third exemplary embodiment. When the lock button 144 is pushed so that the operating plate 142 is moved in the direction B by a biasing force of a spring 143, the tip of the lock shaft 162 abuts on the end face of the main shaft lock plate 161 and the operating plate 142 is stopped in the case in which the lower shaft 6 is not set at a predetermined rotating angle, that is, an angle at which the lock shaft 162 can be engaged with the engaging portion 161*a* of the main shaft lock plate 161 (an angle at which indicators m1 and m2 are coincident with each other) (see FIG. 9B). Consequently, the motor starting switch 361 is turned ON so that the motor 5 is driven and the lower shaft 6 is rotated. In that case, the tip of the lock shaft 162 pressed against the end face of the main shaft lock plate 161 by a biasing force of a spring 143 and the end face of the main shaft lock plate 161 are slid together. Then, the lower shaft 6 is rotated to a position in which the engaging portion 161*a* can be engaged with the lock shaft 162 during one rotation or less so that the lock shaft 162 is inserted into the engaging portion 161*a* (see FIG. 9C). Thus, the motor stopping switch 362 is turned ON so that the motor 5 is stopped. In other words, according to the main shaft locking mechanism 360 in accordance with the third exemplary embodiment, an operator can automatically stop the lower shaft 6 at the predetermined rotating angle irrespective of the rotating angle of the lower shaft 6 by simply pushing down the lock button 144 (the operation input means) by one hand. Consequently, a threading work can further be simplified and carried out easily.

FOURTH EXEMPLARY EMBODIMENT

Next, a fourth exemplary embodiment of the invention will be described in detail with reference to FIG. 12.

The fourth exemplary embodiment is different from the first, second and third exemplary embodiments in that a looper support arm 423 supporting a looper 21 is tilted around a fulcrum shaft 422 which is different from a looper driving shaft 22 when the looper 21 is to be disposed at a rear position, i.e., a threading position by a looper tilting mechanism 450.

The looper support arm 423 according to the fourth exemplary embodiment has a lower end which is rotatably attached to an intermediate part of a looper driving arm 424 above the looper driving shaft 22 through the fulcrum shaft 422 provided in parallel with the looper driving shaft 22. In other words, in the looper tilting mechanism 450 according to the fourth exemplary embodiment, the looper support arm 423 for supporting the looper 21 is tilted in the middle in the case in which the looper driving shaft 22 to be a swiveling center of the looper 21 during a sewing work is set to be a center. A thread guide plate 413 is fixed to an upper part of the looper driving arm 424, and a thread pipe 110 is attached to the thread guide plate 413.

Figure 12A:
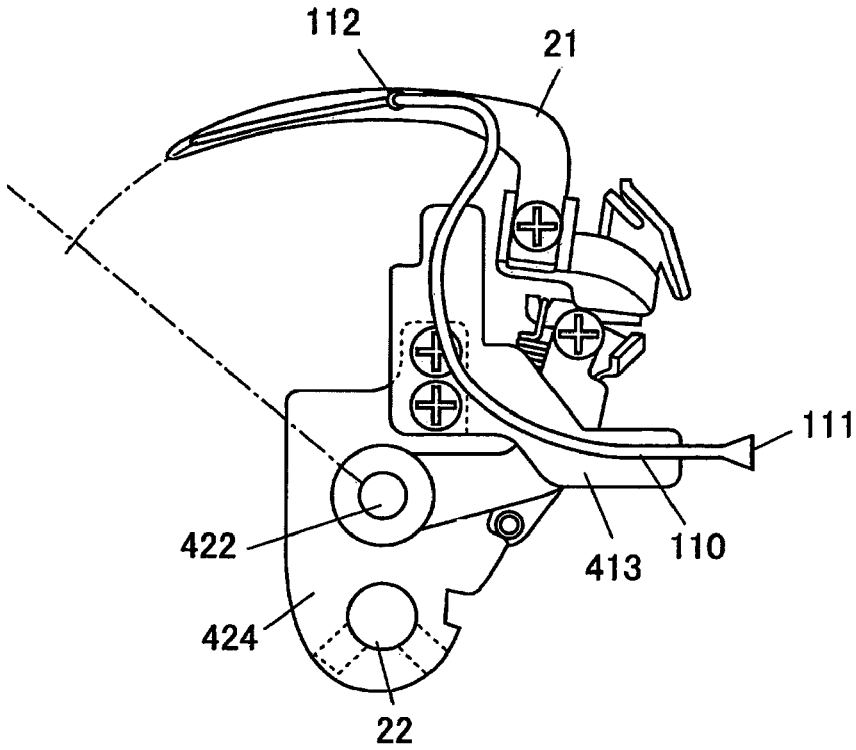
FIGS. 12A and 12B are views illustrating operations of a looper according to a fourth exemplary embodiment of the invention, FIG. 12A showing a looper and a thread pipe at their front positions and FIG. 12B showing the looper at a rear position and the thread pipe at the front position.
Figure 12B:
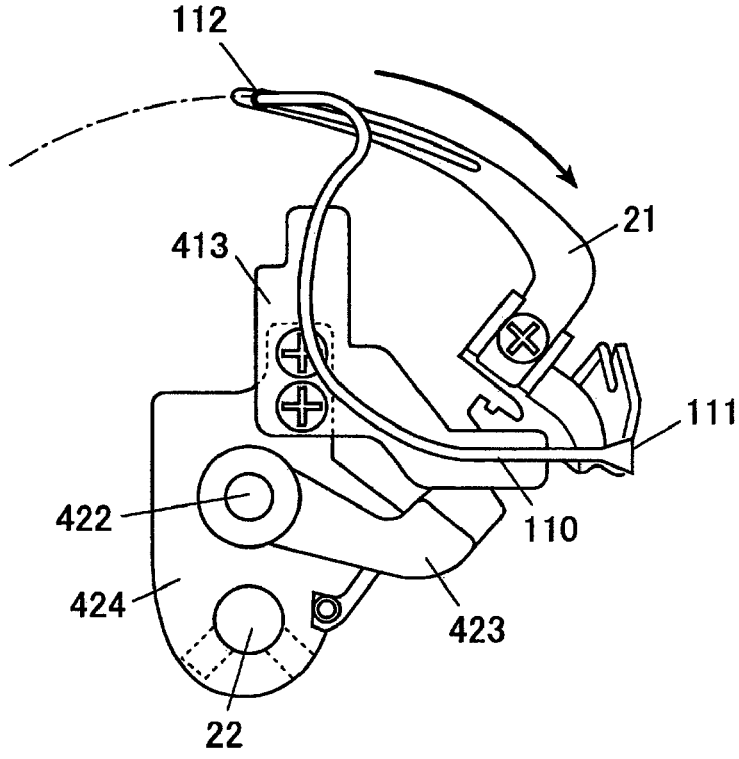

During the stitching work, the looper support arm 423 and the looper driving arm 424 are coupled to each other through a release pin 152 so that the looper 21 is rigidly supported on the looper driving arm 424 and is swiveled in accordance with a rotation of the looper driving shaft 22 (see FIG. 12A).

On the other hand, the release pin 152 is moved so that the looper support arm 423 can be rotated around the fulcrum shaft 422 with respect to the looper driving arm 424 and the looper 21 is tilted to a rearward side in a back and forth movement thereof. Then, the looper 21 is disposed in a threading position in which a thread hole 21*b* and a thread discharging port 112 are coincident with each other (see FIG. 12B).

In the sewing machine of the fourth exemplary embodiment, in the same manner as in the first exemplary embodiment, it is possible to interlock an air spraying unit 120, a main shaft locking mechanism 160 and the looper tilting mechanism 450 by an input operation from an interlocking mechanism 170. Consequently, it is possible to considerably simplify a threading work for inserting a looper thread T through the looper 21.

According to one or more exemplary embodiments of the invention, a coupling state of the looper and the looper shaft can be switched into a connection and a separation by the switching means. When the looper and the looper shaft are brought into the disconnected state by the switching means, the looper can be disposed in the rear position by the moving means. When the looper is disposed in the rear position, moreover, the thread hole of the looper can be coincident with the thread discharging port of the thread pipe disposed in the front position and the thread inserting port of the thread pipe disposed in the front position can be coincident with the tip of the nozzle disposed in the front position. In other words, by bringing the looper and the looper shaft into the disconnected state through the switching means and disposing the nozzle in the front position, it is possible to supply the air to the thread inserting port of the thread pipe and to insert the thread inserted from the thread inserting port by the air through the thread hole of the looper. Consequently, tweezers are not required for inserting the thread through the thread hole of the looper so that the threading work can be considerably simplified as compared with the case in which the thread is inserted through a manual work of an operator. Accordingly, it is possible to eliminate a complicatedness of a conventional threading work, thereby carrying out the threading work easily.

Moreover, the looper is disposed in the rear position to cause the thread hole of the looper to be coincident with the thread discharging port of the thread pipe. Therefore, it is possible to smoothly carry out the threading work without requiring to draw an upper thread laid over the looper and to release a tension of the upper thread.

According to one or more exemplary embodiments of the invention, it is possible to couple the looper support member to a thread pipe support member by sliding the coupling member when the looper support member and the thread pipe support member are disposed in the rear position. In other words, it is possible to switch the connection and disconnection of the looper and the looper shaft in the rear position to be a rotating range of the looper shaft and an oscillating range of the looper. Consequently, the looper separated from the looper shaft by the switching means can be connected within the oscillating range.

According to one or more exemplary embodiments of the invention, interlocking means is provided. Therefore, it is possible to position the main shaft at the predetermined rotating angle such that the thread pipe is placed in the front position interlockingly with an operation for disposing the nozzle in the spraying position and to bring the looper and the looper shaft into the disconnected state by the switching means. By the moving means, it is possible to dispose the loop in the rear position. In other words, it is possible to interlock the main shaft locking mechanism, the switching means and the air supplying means by one operation without operating them separately. Accordingly, the threading work can be considerably simplified and can easily be carried out. Moreover, there is provided the operation input means for manually operating the interlocking means. Consequently, it is possible to enhance an operability of the threading device by an operator.

According to one or more exemplary embodiments of the invention, when the operation input means is manipulated by the operator and the operation input means is switched from the holding position to the permitting position, the nozzle is moved from the standby position to the spraying position by the biasing force of the nozzle biasing means. Interlockingly therewith, moreover, the main shaft is positioned at the predetermined rotating angle by the main shaft locking mechanism and the looper and the looper shaft are brought into the disconnected state by the switching means.

In other words, by providing the nozzle biasing means, it is possible to move the nozzle to the spraying position and to position the main shaft at the predetermined rotating angle by simply manipulating the operation input means. By bringing the looper and the looper shaft into the disconnected state through the switching means, furthermore, it is possible to dispose the looper in the rear position by the moving means. Accordingly, the operator of the sewing machine does not need to use both hands when operating each of the mechanisms, and can thus implement the threading work for inserting the thread through the looper by either of the hands. Consequently, the operability of the sewing machine can be enhanced considerably so that the threading work can easily be carried out.

According to one or more exemplary embodiments of the invention, by the motor control means, the motor starts to be rotated and driven when the main shaft locking mechanism is brought into the operable state in accordance with the input operation from the operation input means. Therefore, also in the case in which the operation input means is operated when the main shaft is not disposed at the predetermined rotating angle, for example, the main shaft can be rotated to have the predetermined rotating angle at which the lock member can be fitted in an engaging portion of a rotating member. In the case in which the nozzle biasing means is provided, it is possible to position the main shaft at the predetermined rotating angle and to automatically stop the main shaft. When the detecting means detects that the main shaft is positioned at the predetermined rotating angle, moreover, the rotating and driving operation of the motor can be stopped automatically by the motor control means. In other words, it is possible to automatically stop the main shaft at the predetermined rotating angle by simply manipulating the operation input means irrespective of whether the main shaft is disposed at the predetermined rotating angle when the operator manipulates the operation input means and to dispose the looper in the rear position through the interlocking means, and furthermore, to dispose the nozzle in the spraying position. Then, it is possible to automatically stop the motor Consequently, it is possible to prevent a rotation of the motor which is not required for the threading work for inserting the thread through the looper. Thus, it is possible to execute the threading work very easily while preventing a waste of a power and an abrasion of the apparatus.

According to one or more exemplary embodiments the invention, the main shaft locking mechanism is stopped at the predetermined rotating angle by means of the rotating member fixed to the main shaft and the lock member to be engaged with the engaging portion of the rotating member. Moreover, the lock member can be energized in such a direction as to be engaged with the engaging portion by the lock member biasing means. Consequently, also in the case in which the main shaft is not disposed at the predetermined rotating angle, for example, it is possible to bring the lock member into an energizing state in such a direction as to be engaged with the engaging portion by manipulating the operation input means. By subsequently disposing the main shaft at the predetermined rotating angle, therefore, it is possible to position the main shaft at the predetermined rotating angle. In other words, the operation input means can be operated irrespective of whether the main shaft is disposed at the predetermined rotating angle, and furthermore, the lock member can be energized in such a direction as to be engaged with the engaging portion by the lock member biasing means. Therefore, the operator can implement each of the operations by either of the hands. Accordingly, the threading work for inserting the thread through the looper can be carried out very easily.

According to one or more exemplary embodiments of the invention, the lock member is fitted in the engaging portion of the rotating member in the axial direction. Consequently, it is possible to place the main shaft in a constant position.

According to one or more exemplary embodiments of the invention, the lock member is fitted in the engaging portion of the rotating member in the radial direction. Consequently, it is possible to place the main shaft in the constant position.

According to one or more exemplary embodiments of the invention, the link member and the lock member are provided to be coaxially and separately rotatable, and the link member and the lock member are coupled to each other through a tension spring. Therefore, when the input operation is carried out through the operation input means, for example, the link member is rotated and the lock member stands by in an abutting state on a peripheral edge of the rotating member in the radial direction even if the main shaft is not positioned at the predetermined rotating angle at which the lock member is fitted. Moreover, the lock member can be energized toward the center of the rotating member by the biasing force of the tension spring in this state. When the main shaft is then rotated and is disposed at the predetermined rotating angle, therefore, the lock member can be fitted in the engaging portion of the rotating member by a biasing force of the tension spring. In other words, the operation input means can be manipulated irrespective of whether the main shaft is disposed at the predetermined rotating angle. Therefore, it is possible to enhance the operability in the threading operation.

According to one or more exemplary embodiments of the invention, by the operation of the operating member, the thread pipe can be moved to the front position and the looper placed in the front position can be separated from the looper shaft, and the looper can be moved to the rear position. Thus, the threading work can be simplified so that a working efficiency can be enhanced.

According to one or more exemplary embodiments of the invention, by the operation of the operating member, it is possible to place the looper in the rear position and to move the nozzle to the spraying position. Therefore, the threading work can be simplified so that the working efficiency can be enhanced.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A sewing machine comprising:

a looper having an extended portion, wherein a thread hole is formed on a tip portion of the extended portion, and a looper groove is formed along the extended portion;

a looper shaft holding the looper such that the looper is swivelable between a front position and a rear position in synchronization with a vertical motion of a needle and interlockingly with a motor;

a thread pipe fixed to the looper shaft, wherein a thread inserting port at one end of the thread pipe and a thread discharging port at the other end of the thread pipe is communicated such that a thread can be inserted therethrough;

air supplying means for supplying air toward the thread inserting port when a nozzle is disposed at a spraying position opposed to the thread inserting port of the thread pipe;

switching means for disconnecting the looper from the looper shaft when the looper is at the front position; and moving means for moving the looper, which is disconnected from the looper shaft by the switching means, to the rear position, wherein, when the looper is disconnected from the looper shaft and is moved to the rear position, the thread discharging port of the thread pipe becomes coincident with the thread hole of the looper, and the thread inserting port of the thread pipe becomes coincident with a tip of the nozzle disposed at the spraying position.

2. The sewing machine according to claim 1, further comprising:

a looper support member supporting the looper and is rotatable with respect to the looper shaft;

a looper driving member fixed to the looper shaft; and a coupling member which is movable along an axial direction of the looper shaft, wherein the coupling member is operable to connect or disconnect the looper support member and the looper driving member when the coupling member is moved while the looper and the thread pipe are disposed at the respective rear positions.

3. The sewing machine according to claim 1, further comprising:

a main shaft locking mechanism which positions a main shaft at a predetermined rotating angle at which the thread pipe is disposed at the front position through the looper shaft; and operation input means for moving the nozzle to the spraying position, bringing the switching means into a disconnecting state, and bringing the main shaft locking mechanism into an operable state.

4. The sewing machine according to claim 3, wherein the air supplying means allows the nozzle to move between the spraying position and a standby position placed apart from the spraying position, the air supplying means includes nozzle biasing means for biasing the nozzle toward the spraying position, and a position of the operation input means switchable between a holding position at which the nozzle is held at the standby position against a biasing force of the nozzle biasing means and a permitting position at which the nozzle biasing means is movable to the spraying position by the biasing force.

5. The sewing machine according to claim 3, further comprising:

detecting means for detecting that the main shaft is positioned at the predetermined rotating angle by the main shaft locking mechanism; and motor control means for starting of a rotation of the motor when the main shaft locking mechanism is brought into the operable state in accordance with an input operation from the operation input means and stopping the rotation of the motor when the main shaft is positioned at the predetermined rotating angle.

6. The sewing machine according to claim 3, wherein the main shaft locking mechanism comprises:

a rotating member having an engaging portion and fixed to the main shaft;

a lock member which positions the main shaft at the predetermined rotating angle when engaged with the engaging portion; and lock member biasing means for biasing the lock member in a direction in which the lock member engages with the engaging portion.

7. The sewing machine according to claim 6, wherein the engaging portion is an opening portion formed on the rotating member, and the lock member engages with the opening portion of the rotating member in an axial direction of the main shaft.

8. The sewing machine according to claim 6, wherein the engaging portion is an opening portion formed on the rotating member, and the lock member engages with the opening portion of the rotating member in a radial direction of the main shaft.

9. The sewing machine according to claim 6, wherein the main shaft locking mechanism further comprises a link member which rotates in accordance with an input operation from the operation input means, wherein the lock member and the link member share a same rotating axis and are separately rotatable, and the lock member biasing means includes a tension spring coupling the link member and the lock member.

10. The sewing machine according to claim 1, further comprising:

an operating member which is movable when operated from an outside of the sewing machine; and a main shaft locking mechanism which positions a main shaft at a predetermined rotating angle, at which the thread pipe is movable to the front position, interlockingly with the movement of the operating member, wherein the switching means comprises a switching member coupled to the looper and supported by the looper shaft so as to be movable along an axial direction of the looper shaft such that the switching member disconnects the looper from the looper shaft interlockingly with the movement of the operating member when the looper is disposed at the front position, and the moving means comprises an acting member which moves the looper to the rear position when the switching member is moved to disconnect the looper from the looper shaft.

11. The sewing machine according to claim 1, further comprising:

an operating member which is movable when operated from an outside of the sewing machine; and a main shaft locking mechanism which positions a main shaft at a predetermined rotating angle, at which the thread pipe is movable to the front position, interlockingly with the movement of the operating member, wherein the air supplying means is operable to move the nozzle between to the spraying position and a standby position placed apart from the spraying position, and the operating member is coupled to the nozzle such that, when the operating member is moved, the looper is disposed at the rear position and the nozzle is moved to the spraying position.

12. A sewing machine comprising:

a looper formed with a thread hole;

a looper shaft holding the looper such that the looper is swivelable between a front position and a rear position;

a thread pipe fixed to the looper shaft such that the thread pipe is swivelable between a front position and a rear position, wherein the thread pipe comprises a thread inserting port at one end and a thread discharging port at the other end;

an air spraying unit comprising a nozzle from which air is sprayed toward the thread inserting port;

a switching mechanism operable to disconnect the looper from the looper shaft when the looper is at the front position; and a moving member which moves the looper to the rear position when the looper is disconnected from the looper shaft by the switching mechanism, wherein, when the looper is disconnected from the looper shaft and is moved to the rear position, the thread discharging port of the thread pipe becomes coincident with the thread hole of the looper, and a distance between the thread inserting port and the nozzle becomes minimum.

* * * * *